US006660711B1

(12) United States Patent
Price et al.

(10) Patent No.: US 6,660,711 B1
(45) **Date of Patent: *Dec. 9, 2003**

(54) LAUNDRY DETERGENT COMPOSITIONS COMPRISING ZWITTERIONIC POLYAMINES AND MID-CHAIN BRANCHED SURFACTANTS

(75) Inventors: Kenneth Nathan Price, Cincinnati, OH (US); Eugene Paul Gosselink, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 162 days.

This patent is subject to a terminal disclaimer.

(21) Appl. No.: 09/980,799

(22) PCT Filed: Jul. 13, 2000

(86) PCT No.: PCT/US00/19084

§ 371 (c)(1),
(2), (4) Date: Dec. 3, 2001

(87) PCT Pub. No.: WO01/05923

PCT Pub. Date: Jan. 25, 2001

Related U.S. Application Data

(60) Provisional application No. 60/160,431, filed on Oct. 19, 1999, provisional application No. 60/160,324, filed on Oct. 19, 1999, provisional application No. 60/160,272, filed on Oct. 19, 1999, provisional application No. 60/160,289, filed on Oct. 19, 1999, provisional application No. 60/141,321, filed on Jul. 16, 1999, provisional application No. 60/144,110, filed on Jul. 16, 1999, provisional application No. 60/144,113, filed on Jul. 16, 1999, and provisional application No. 60/144,111, filed on Jul. 16, 1999.

(51) Int. Cl.[7] ..... C11D 1/94; C11D 3/26; C11D 3/30

(52) U.S. Cl. ..... 510/499; 510/321; 510/337; 510/303; 510/309; 510/310; 510/311; 510/312; 510/504; 510/338; 510/393

(58) Field of Search ..... 510/321, 337, 510/338, 340, 393, 499, 504, 303, 309, 310, 311, 312

(56) References Cited

U.S. PATENT DOCUMENTS

| | | | |
|---|---|---|---|
| 3,128,287 | A | 4/1964 | Berg |
| 3,159,581 | A | 12/1964 | Diehl |
| 3,213,030 | A | 10/1965 | Diehl |
| 3,234,258 | A | 2/1966 | Morris |
| 3,308,067 | A | 3/1967 | Diehl |
| 3,400,148 | A | 9/1968 | Quimby |
| 3,422,021 | A | 1/1969 | Roy |
| 3,422,137 | A | 1/1969 | Quimby |
| 3,635,830 | A | 1/1972 | Lamberti et al. |
| 3,642,572 | A | 2/1972 | Endres et al. |
| 3,723,322 | A | 3/1973 | Diehl |
| 3,923,679 | A | 12/1975 | Rapko |
| 3,929,678 | A | 12/1975 | Laughlin et al. |
| 3,985,669 | A | 10/1976 | Krummel et al. |
| 4,102,903 | A | 7/1978 | Crutchfield et al. |
| 4,120,874 | A | 10/1978 | Crutchfield et al. |
| 4,144,123 | A | 3/1979 | Scharf et al. |
| 4,144,226 | A | 3/1979 | Crutchfield et al. |
| 4,158,635 | A | 6/1979 | Crutchfield et al. |
| 4,174,291 | A | 11/1979 | Benjamin et al. |

(List continued on next page.)

FOREIGN PATENT DOCUMENTS

| | | |
|---|---|---|
| EP | 200 263 | 11/1986 |
| EP | 0 122 593 | 7/1989 |
| EP | 0 269 169 B1 | 8/1992 |
| EP | 544440 A2 | 6/1993 |
| EP | 544490 A1 | 6/1993 |
| EP | 549271 A1 | 6/1993 |
| WO | 549272 A1 | 6/1993 |
| WO | WO 94/28102 A1 | 12/1994 |
| WO | WO 97/23546 | 7/1997 |
| WO | WO 97/42283 | 11/1997 |
| WO | WO 97/42284 | 11/1997 |
| WO | WO 97/42286 | 11/1997 |
| WO | WO 97/42287 | 11/1997 |
| WO | WO 98/15607 | 4/1998 |
| WO | WO 98/39406 A1 | 9/1998 |
| WO | WO 99/05082 | 2/1999 |
| WO | WO 99/05084 | 2/1999 |
| WO | WO 99/05242 | 2/1999 |
| WO | WO 99/19429 A | 4/1999 |
| WO | WO 99/19434 | 4/1999 |
| WO | WO 99/19439 | 4/1999 |
| WO | WO 99/19443 | 4/1999 |
| WO | WO 99/19444 | 4/1999 |
| WO | WO 99/19448 | 4/1999 |
| WO | WO 99/19449 | 4/1999 |
| WO | WO 99/19450 | 4/1999 |
| WO | WO 99/19451 | 4/1999 |
| WO | WO 99/19453 | 4/1999 |
| WO | WO 99/19454 | 4/1999 |

OTHER PUBLICATIONS

*Bleaching Agents*, Kirk Othmer's Encyclopedia of Chemical Technology, 4$^{th}$ ed., pp. 271–300, 1992.

Tobe, *Base Hydrolysis of Transition–Metal Complexes*, Advanced Inorganic Bioinorganic Mech, 2, 1983, pp. 1–94.

J. Chem. Ed., 1989, vol. 66 (12), pp. 1043–1045.

Inorg. Chem., 1979, vol. 18, pp. 1497–1502 and pp. 2023–2025.

Inorg. Chem., 1982, vol. 21, pp. 2881–2885.

Inorg. Syntheses, 1960, pp. 173–176.

Journal of Physical Chemistry, 1952, vol. 56 pp. 22–25.

*Primary Examiner*—Gregory Delcotto
(74) *Attorney, Agent, or Firm*—Kim W. Zerby; Steven W. Miller

(57) ABSTRACT

The present invention relates to laundry detergent compositions which provide enhanced hydrophilic soil cleaning benefits, said compositions comprising from about 0.01% by weight of a zwitterionic polyamine, b) from about 0.01% by weight of a surfactant system; c) and the balance, adjunct ingredients.

11 Claims, No Drawings

U.S. PATENT DOCUMENTS 4,371,674 A 2/1983 Hertel et al.
4,412,934 A 11/1983 Chung et al.
4,430,243 A 2/1984 Bragg
4,565,647 A 1/1986 Llenado
4,566,984 A 1/1986 Bush
4,585,642 A 4/1986 Rieck
4,634,551 A 1/1987 Burns et al.
4,663,071 A 5/1987 Bush et al.
4,664,839 A 5/1987 Rieck
4,664,848 A * 5/1987 Oh et al. ..... 252/547
4,728,455 A 3/1988 Rerek
4,810,410 A 3/1989 Diakun et al.
4,950,310 A 8/1990 Rieck et al.
4,966,723 A 10/1990 Hodge et al.
5,075,041 A 12/1991 Lutz
5,114,606 A 5/1992 Nan Vliet et al.
5,114,611 A 5/1992 Van Kralingen et al.
5,130,045 A 7/1992 Mitchell et al.
5,153,161 A 10/1992 Kerschner et al.
5,194,416 A 3/1993 Jureller et al.
5,227,084 A 7/1993 Martens et al.
5,244,594 A 9/1993 Favre et al.
5,246,612 A 9/1993 Van Dijk et al.
5,246,621 A 9/1993 Favre et al.
5,256,779 A 10/1993 Kerschner et al.
5,274,147 A 12/1993 Kerschner et al.
5,280,117 A 1/1994 Kerschner et al.
5,284,944 A 2/1994 Madison et al.
5,349,101 A 9/1994 Lutz et al.
5,389,277 A 2/1995 Prieto
5,405,412 A 4/1995 Willey et al.
5,405,413 A 4/1995 Willey et al.
5,451,341 A 9/1995 White
5,454,982 A 10/1995 Murch et al.
5,460,747 A 10/1995 Gosselink et al.
5,489,393 A 2/1996 Connor et al.
5,503,639 A 4/1996 Willey et al.
5,523,434 A 6/1996 Burns et al.
5,565,145 A 10/1996 Watson et al.
5,576,282 A 11/1996 Miracle et al.
5,578,136 A 11/1996 Taylor et al.
5,584,888 A 12/1996 Miracle et al.
5,595,967 A 1/1997 Miracle et al.
5,597,936 A 1/1997 Perkins et al.
5,654,421 A 8/1997 Taylor et al.
5,686,014 A 11/1997 Baillely et al.
5,686,015 A 11/1997 Willey et al.
5,686,401 A 11/1997 Willey et al.
5,695,679 A 12/1997 Christie et al.
5,698,504 A 12/1997 Christie et al.
5,703,030 A 12/1997 Perkins et al.
5,858,348 A 1/1999 Matsuda et al.
5,998,350 A 12/1999 Burns et al.
6,004,922 A 12/1999 Watson et al.
6,008,181 A 12/1999 Cripe et al.
6,015,781 A 1/2000 Vinson et al.
6,020,303 A 2/2000 Cripe et al.
6,046,152 A 4/2000 Vinson et al.
6,057,278 A 5/2000 Gosselink et al.
6,060,443 A 5/2000 Cripe et al.
6,066,612 A 5/2000 Murata et al.
6,071,871 A 6/2000 Gosselink et al.
6,075,000 A 6/2000 Rohrbaugh et al.
6,087,316 A 7/2000 Watson et al.
6,093,856 A 7/2000 Cripe et al.
6,121,226 A 9/2000 Gosselink et al.
6,133,222 A 10/2000 Vinson et al.
6,153,577 A 11/2000 Cripe et al.
6,191,093 B1 2/2001 Watson et al.
6,228,829 B1 5/2001 Vinson et al.
6,232,282 B1 5/2001 Kvietok et al.
6,242,406 B1 6/2001 Katsuda et al.
6,274,540 B1 8/2001 Scheibel et al.
6,281,181 B1 8/2001 Vinson et al.
6,291,415 B1 9/2001 Watson et al.
6,306,817 B1 10/2001 Kott et al.
6,326,348 B1 12/2001 Vinson et al.
6,369,024 B1 4/2002 Panandiker et al.
6,380,143 B1 4/2002 Kvietok et al.
6,444,633 B2 * 9/2002 Price ..... 510/299
6,448,213 B1 9/2002 Willman
6,472,359 B1 * 10/2002 Ghosh ..... 510/321
6,479,451 B2 * 11/2002 Price ..... 510/303
6,482,789 B1 11/2002 Kvietok et al.
6,498,134 B1 12/2002 Scheibel et al.
6,506,717 B1 1/2003 Kott et al.
6,525,012 B2 * 2/2003 Price et al. ..... 510/321

* cited by examiner

LAUNDRY DETERGENT COMPOSITIONS COMPRISING ZWITTERIONIC POLYAMINES AND MID-CHAIN BRANCHED SURFACTANTS

This application claims priority under 35 USC 119(e) to U.S. Provision appl. No.(s) 60/160,431, filed Oct. 19, 1999, Ser. No. 60/160,324, filed Oct. 19, 1999, Ser. No. 60/160,272, filed Oct. 19, 1999, Ser. No. 60/160,289, filed Oct. 19, 1999, Ser. No. 60/144,321, filed Jul. 16, 1999, Ser. No. 60/144,110, filed Jul. 16, 1999, Ser. No. 60/144,113, filed Jul. 16, 1999, and Ser. No. 60/144,111, filed Jul. 16, 1999.

FIELD OF THE INVENTION

The present invention relates to laundry detergent compositions which provide enhanced hydrophilic soil, inter alia, clay, removal benefits. The laundry detergent compositions of the present invention combine zwitterionic polyamines and a surfactant system which comprises mid-chain branched surfactants inter alia mid-chain branched alkyl sulphonates. The present invention further relates to methods for cleaning fabric having heavy clay soil deposits.

BACKGROUND OF THE INVENTION

Fabric, especially clothing, can become soiled with a variety of foreign substances ranging from hydrophobic stains (grease, oil) to hydrophilic stains (clay). The level of cleaning which is necessary to remove said foreign substances depends to a large degree upon the amount of stain present and the degree to which the foreign substance has contacted the fabric fibers. Grass stains usually involve direct abrasive contact with vegetative matter thereby producing highly penetrating stains. Clay soil stains, although in some instances contacting the fabric fibers with less force, nevertheless provide a different type of soil removal problem du to the high degree of charge associated with the clay itself. This high surface charge density may act to repel some laundryadjunct ingredients, inter alia, clay dispersants, thereby resisting any appreciable solublizing of the clay into the laundry liquor.

A surfactant per se is not all that is necessary to remove unwanted clay soils and stains. In fact, not all surfactants work equally well on all types of stains. In addition to surfactants, polyamine hydrophilic soil dispersants are added to laundry detergent compositions to "carry away" clay soils from the fabric surface and to remove the possibility that the clay soil will be re-deposited upon the fabric. However, unless the clay can be initially solublized away from the fabric fiber, especially in the case of hydrophilic fibers, inter alia, cotton, there will be nothing in solution for the dispersants to chelate.

There is a long felt need in the art for laundry detergent compositions which can effectively solublize embedded clay and other hydrophilic soils from fabric. There has further been a long felt need for a method for cleaning hydrophilic soils from fabric wherein the hydrophilic soils are effectively solublized into the laundry liquor.

SUMMARY OF THE INVENTION

The present invention meets the aforementioned needs in that it has been surprisingly discovered that certain zwitterionic polyamines in combination with a surfactant system comprising one or more mid-chain branched surfactants provides enhance removal of clay and other hydrophilic soils from fabric.

The first aspect of the present invention relates to a laundry detergent composition comprising:

a) from about 0.01%, preferably from about 0.1%, more preferably from 1%, most preferably from 3% to about 20%, preferably to about 10%, more preferably to about 5% by weight, of a zwitterionic polymer which comprises a polyamine backbone wherein one or more of said polyamine backbone amino units are quaternized and wherein said polyamine backbone is substituted by one or more units capable of having an anionic charge such that the number of anionic units present in said zwitterionic polymer exceeds the number of backbone quaternized units;

b) from about 0.01%, preferably from about 0.1%, more preferably from about 1% to about 100%, preferably to about 80% by weight, preferably to about 60%, most preferably to about 30% by weight, of a surfactant system comprising one or more mid-chain branched surfactants selected from the group consisting of mid-chain branched alkyl sulfates, mid-chain branched alkoxy sulfates, mid-chain branched aryl sulphonates, and mixtures thereof; and c) the balance carriers and adjunct ingredients.

The present invention further relates to granular laundry detergent compositions which comprise a surfactant system wherein said surfactant system comprises from about 0.01%, preferably from about 0.1% more preferably from about 1% to about 100%, preferably to about 80% by weight, preferably to about 60%, most preferably to about 30% by weight, of a surfactant which is not a mid-chain branched surfactant, said surfactant selected from the group consisting of anionic, cationic, zwitterionic, nonionic, ampholytic surfactants, and mixtures thereof.

The present invention also relates to laundry detergent compositions which comprise zwitterionic polyamines having a hydrophilic backbone and an anionic tether which when taken together comprises a net anionic charge of at least 1, preferably at least 2, more preferably at least 3.

Another aspect of the present invention relates to a granular laundry detergent composition comprising:

a) from about 0.01%, preferably from about 0.1%, more preferably from 1%, most preferably from 3% to about 20%, preferably to about 10%, more preferably to about 5% by weight, of a zwitterionic polymer which comprises a polyamine backbone, said backbone comprising two or more amino units wherein at least one of said amino units is quaternized and wherein at least one amino unit is substituted by one or more moieties capable of having an anionic charge wherein further the number of amino unit substitutions which comprise an anionic moiety is less than or equal to the number of quaternized backbone amino units;

b) from about 0.01%, preferably from about 0.1% more preferably from about 1% to about 100%, preferably to about 80% by weight, preferably to about 60%, most preferably to about 30% by weight, of a surfactant system comprising one or more mid-chain branched surfactants selected from the group consisting of mid-chain branched alkyl sulfates, mid-chain branched alkoxy sulfates, mid-chain branched aryl sulphonates, and mixtures thereof; and c) the balance carriers and adjunct ingredients.

A further aspect of the present invention relates to nil bleach compositions which comprise:

a) from about 0.01%, preferably from about 0.1%, more preferably from 1%, most preferably from 3% to about 20%, preferably to about 10%, more preferably to about 5% by weight, of a zwitterionic polyamine according to the present invention;

b) from about 0.01%, preferably from about 0.1% more preferably from about 1% to about 100%, preferably to about 80% by weight, preferably to about 60%, most preferably to about 30% by weight, of a surfactant system comprising:

i) from 0% to 80% by weight, of a mid-chain branched alkyl sulfate surfactant, a mid-chain branched alkyl alkoxy sulfate surfactant, and mixtures thereof;

ii) from 0% to 80% by weight, of a mid-chain branched aryl sulfonate surfactant;

iii) optionally from 0.01% by weight, of a surfactant selected from the group consisting of anionic, nonionic, cationic, zwitterionic, ampholytic surfactants, and mixtures thereof;

c) from about 0.001% by weight, of a detersive enzyme, said enzyme selected from the group consisting of protease, amylases, lipases, cellulases, peroxidases, hydrolases, cutinases, mannanases, xyloglucanases, and mixtures thereof; and d) the balance carriers and adjunct ingredients.

A yet further aspect of the present invention relates to nil bleach compositions which comprise:

a) from about 0.01%, preferably from about 0.1%, more preferably from 1%, most preferably from 3% to about 20%, preferably to about 10%, more preferably to about 5% by weight, of a zwitterionic polyamine according to the present invention;

b) from about 0.01%, preferably from about 0.1% more preferably from about 1% to about 100%, preferably to about 80% by weight, preferably to about 60%, most preferably to about 30% by weight, of a surfactant system comprising:

i) from 0% to 80% by weight, of a mid-chain branched alkyl sulfate surfactant, a mid-chain branched alkyl alkoxy sulfate surfactant, and mixtures thereof;

ii) from 0% to 80% by weight, of a mid-chain branched aryl sulfonate surfactant;

iii) optionally from 0.01% by weight, of a surfactant selected from the group consisting of anionic, nonionic, cationic, zwitterionic, ampholytic surfactants, and mixtures thereof;

c) from about 1 ppb (0.0000001%), preferably from about 100 ppb (0.00001%), more preferably from about 500 ppb (0.00005%), most preferably from about 1 ppm (0.0001%) to about 99.9%, preferably to about 50%, more preferably to about 5%, most preferably to about 500 ppm (0.05%) by weight, of a transition-metal fabric cleaning catalyst; and d) the balance carriers and adjunct ingredients.

A yet further aspect of the present invention relates to a handwash laundry detergent composition comprising:

a) from about 0.01%, preferably from about 0.1%, more preferably from 1%, most preferably from 3% to about 20%, preferably to about 10%, more preferably to about 5% by weight, of a zwitterionic polymer which comprises a polyamine backbone wherein one or more of said polyamine backbone amino units are quaternized and wherein said polyamine backbone is substituted by one or more units capable of having an anionic charge such that the value of the charge ratio, $Q_r$, is from greater than about 1 to about 4, preferably to about 2, where said $Q_r$, is defined as:

$$Q_r = \frac{\sum q_{anionic}}{\sum q_{cationic}}$$

wherein $q_{anionic}$ is an anionic unit and $q_{cationic}$ represents a quaternized backbone nitrogen;

b) from about 0.01%, preferably from about 0.1% more preferably from about 1% to about 100%, preferably to about 80% by weight, preferably to about 60%, most preferably to about 30% by weight, of a surfactant system comprising one or more mid-chain branched surfactants selected from the group consisting of mid-chain branched alkyl sulfates, mid-chain branched alkoxy sulfates, mid-chain branched aryl sulphonates, and mixtures;

c) from about 1%, preferably from about 5%, more preferably from about 10%, most preferably from about 15% to about 80%, preferably to about 50%, more preferably to about 30% by weight, of a detergent builder; and d) the balance carriers and adjunct ingredients.

Included in the objects of the present invention are laundry detergent compositions which comprise a high level of a builder, said compositions suitable for use in area wherein laundering is conducted by hand in high hardness water.

The present invention also relates to a method for removing hydrophilic stains from fabric by contacting fabric in need of cleaning with an aqueous solution comprising at least 1 ppm (0.0001%), preferably at least 5 ppm (0.0005%), more preferably at least 10 ppm (0.001%) of the zwitterionic polymer.

These and other objects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to the surprising discovery that the combination of a zwitterionic polyamine having a hydrophilic backbone and a surfactant system which comprises at least one mid-chain branched surfactant provides enhanced benefits for removal of clay soil from fabric especially clothing. It has been surprisingly discovered that the formulator, by selecting the relative degree of quaternization of the polyamine backbone and the type of anionic units which substitute the polyamine backbone, is able to form a zwitterionic polymer which can be tailored for optimization depending upon the desired execution. Preferably, as described herein below, the zwitterionic polymers which are incorporated into granular laundry detergent compositions typically have an excess number of anionic units relative to the number of quaternized backbone nitrogens.

In fact, it has been surprisingly discovered that the zwitterionic polymers of the present invention overcome the problems which occur due to high soil loading, inter alia, loss of surfactant strength when used in combination with one or more mid-chain branched surfactants. The issue of high soil loading is especially germane to the consumer who hand washes fabric thereby exposing the fabric which is laundered at the end of the laundry queue to laundry liquors which are already highly saturated with soils.

It has also been surprisingly discovered that the zwitterionic polymers of the present invention have, in some embodiments, enhanced soil removal properties in high water hardness uses.

For the purpose of the present invention the term "hardness" relates to the amount of cations, calcium, inter alia, which are dissolved in the water and which tend to diminish the surfactancy and cleaning capacity of surfactants. The term "hard water" is a relative term and for the purposes of the present invention, water having at least "12 grams per gallon water (gpg, "American grain hardness" units) of calcium ion" is defined as "high hardness" and water having at least "18 gpg of calcium ion" is defined as "very high hardness".

For the purposes of the present invention the term "charge ratio", $Q_r$, is defined herein as "the quotient derived from dividing the sum of the number of anionic units present excluding counter ions by the sum of the number of quaternary ammonium backbone units". The charge ratio is defined by the expression:

$$Q_r = \frac{\sum q_{anionic}}{\sum q_{cationic}}$$

wherein $q_{anionic}$ is an anionic unit, inter alia, —$SO_3M$, as defined herein below and $q_{cationic}$ represents a quaternized backbone nitrogen.

For the purposes of the present invention the term "anionic character", ΔQ, is defined herein as "the sum of the number of anionic units which comprise the zwitterionic polymer minus the number of quaternary ammonium backbone units". The greater the excess number of anionic units, the greater the anionic character of the zwitterionic polymer. It will be recognized by the formulator that some anionic units may have more than one unit which has a negative charge. For the purposes of the present invention units having more than one negatively charged moiety, —$CH_2CH(SO_3M)CH_2SO_3M$, inter alia, will have each moiety capable of having a negative charge counted toward the sum of anionic units, therefore, this unit will count as 2 anionic units. The anionic character is defined by the expression:

$$\Delta Q = \Sigma q_{anionic} - \Sigma q_{cationic}$$

wherein $q_{anionic}$ and $q_{cationic}$ are the same as defined herein above.

Those of skill in the art will realize that the greater the number of amine units which comprise the polyamine backbones of the present invention the greater the number of potential cationic units will be contained therein. For the purposes of the present invention the term "degree of quaternization" is defined herein as "the number of backbone units which are quaternized divided by the number of backbone units which comprise the polyamine backbone". The degree of quaternization, Q(+), is defined by the expression:

$$Q(+) = \frac{\sum \text{quaternized backbone nitrogens}}{\sum \text{quaternized backbone nitrogens}}$$

wherein a polyamine having all of the quaternizable backbone nitrogens quaternized will have a Q(+) equal to 1. For the purposes of the present invention the term "quaternizable nitrogen" refers to nitrogen atoms in the polyamine backbone which are capable of forming quaternary ammonium ions. This excludes nitrogens not capable of ammonium ion formation, inter alia, amides.

As described herein below, a key aspect of the present invention is the finding that the formulator, by adjusting the parameters $Q_r$, ΔQ, and Q(+), will be capable of customizing a polymer for formulation into any type of laundry detergent composition having enhanced particulate soil removal benefits throughout a wide variety of settings, for example as a function of (1) the nature of the polymeric structure itself (e.g., EO level, MW, length and HLB of the amine backbone, etc.), (2) the detergent matrix (e.g., pH, type of surfactant, free hardness level), (3) the particular embodiment (e.g., granular, liquids, gel, structured liquid, tablet, non-aqueous, etc.), and (4) desired benefit (e.g., clay stain removal, whiteness, dingy cleaning, etc.). Therefore, in one desired embodiment the zwitterionic polymers of the present invention may have a $Q_r$ of from about 1 to about 2, whereas another embodiment will employ zwitterionic polymers having a $Q_r$ greater than 2. Specific embodiments, as described herein below, may require a $Q_r$ significantly less than 1 or even zero.

Granular laundry detergent compositions per se may comprise clay soil dispersants which chelate the cationic clay particles in solution and hold the particles in solution until they are removed during the rinsing process thus preventing the particles from re-depositing upon the fabric surface. Two examples of preferred hydrophilic dispersants which are further described herein below are as follows: (1) a dispersant which comprises a polyethyleneimine backbone having an average molecular weight of about 189 daltons and in which each nitrogen which comprises said backbone has the appended hydrogen atom(s) replaced by an ethyleneoxy unit having from 15 to 18 residues on average. This preferred ethoxylated polyethyleneimine dispersant is herein after referred to as PEI 189 E15-18. This dispersant is highly effective in dispersing clay soils once the clay soils are removed from fabric. (2) a dispersant which comprises a hexamethylene diamine backbone and in which each nitrogen comprising said backbone has the appended hydrogen atom replaced by an ethyleneoxy unit from about 15 to 25 residues on average. This preferred ethoxylated polyethyleneimine dispersant is herein after referred to as HMD E15-25. This dispersant is also highly effective in dispersing clay soils once the clay soils are removed from fabric.

Subtle changes to the structure of polyalkyleneimines can provide profound changes to the properties thereof. For example, a preferred hydrophobic dispersant capable of dispersing soot, grime, oils, carbonaceous material, comprises a polyethyleneimine having a backbone with an average molecular weight of about 1800 daltons and in which each nitrogen which comprises said backbone has the appended hydrogen atom replaced by an ethyleneoxy unit having from about 0.5 to about 10 residues on average, preferably an average of 7 residues, for example, PEI 1800 E7. The ability to affect profound changes in the properties of polyamines by making small changes to the structure of said polyamines is known and appreciated throughout the laundry art.

Knowing the propensity of these polyamines to exhibit activity in the aqueous laundry liquor, it is therefore surprising and highly unexpected that zwitterionic polyamines having hydrophilic backbone components would act synergistically with certain mid-chain branched surfactants to enhance the removal of clay and other hydrophilic soils directly from fabric fiber itself. Without wishing to be bound by theory it is believed the zwitterionic polyamines of the present invention interact with the mid-chain branched surfactants in a manner which makes clay and other cationic surfaces more anionic in nature. It is believed this system absorbs the modified clay particles from the fiber surface and the inherent agitation associated with the laundry process (for example, the agitation provided by an automatic washing machine) acts to break the once formed complexes loose from the fabric surface and disperse them into solution. The clay and other hydrophilic particles which are removed by the compositions of the present invention are those types of stains or particles which are not removed by normal surfactant/dispersant systems.

Although other surfactants, inter alia, non mid-chain branched sulphonates and sulphates, nonionic surfactants, are highly desirable components of the herein described granular laundry detergent compositions, their absence or presence does not affect the ability of the zwitterionic polyamine/mid-chain branched surfactant system to enhance clay soil removal.

The present invention also relates to the surprising discovery that the combination of a zwitterionic polyamine having a hydrophilic backbone and a surfactant system which comprises at least one mid-chain branched surfactant provides enhanced benefits for removal of clay soil from fabric without the need for a peroxygen bleaching, inter alia, NOBS/perborate, in a liquid laundry detergent matrix when said polyamine and surfactant are combined with one or more transition-metal fabric cleaning catalysts. In addition, the present invention relates to a zwitterionic polymer/surfactant system which is compatible of providing enhanced cleaning together with one or more enzymes. Preferably, as described herein below, the zwitterionic polymers which are incorporated into liquid laundry detergent compositions have an excess number of quaternized backbone nitrogens relative to the number of anionic units which are present.

The laundry detergent compositions of the present invention may take any form, for example, solid, including granular, powder, tablet, or liquid, including gels, paste, thixotropic liquids, etc.

The following is a detailed description of the require elements of the present invention.

Zwitterionic Polyamines

The zwitterionic polyamines of the present invention comprise from about 0.01%, preferably from about 0.1%, more preferably from 1%, most preferably from 3% to about 20%, preferably to about 10%, more preferably to about 5% by weight, of the final laundry detergent composition. The present invention relates to granular laundry detergent compositions which can take any solid, particle, or other granular form. In another embodiment the zwitterionic polymers of the present invention are suitable for use in liquid laundry detergent compositions, inter alia, gels, thixotropic liquids, and pourable liquids (i.e., dispersions, isotropic solutions). The zwitterionic polymers of the present invention are comprised of a polyamine backbone wherein the backbone units which connect the amino units can be modified by the formulator to achieve varying levels of product enhancement, inter alia, boosting of clay soil removal by surfactants, greater effectiveness in high soil loading usage. In addition to modification of the backbone compositions, the formulator may preferably substitute one or more of the backbone amino unit hydrogens by other units, inter alia, alkyleneoxy units having a terminal anionic moiety. In addition, the nitrogens of the backbone may be oxidized to the N-oxide. Preferably at least two of the nitrogens of the polyamine backbones are quaternized.

For the purposes of the present invention "cationic units" are defined as "units which are capable of having a positive charge". For the purposes of the zwitterionic polyamines of the present invention the cationic units are the quaternary ammonium nitrogens of the polyamine backbones. For the purposes of the present invention "anionic units" are defined as "units which are capable of having a negative charge". For the purposes of the zwitterionic polyamines of the present invention the anionic units are "units which alone, or as a part of another unit, substitute for hydrogens along the polyamine backbone" a non-limiting example of which is a $—(CH_2CH_2O)_{20}SO_3Na$ which is capable of replacing a backbone hydrogen.

The zwitterionic polyamines of the present invention have the formula:

$$[J—R]_n—J$$

wherein the [J—R] units represent the amino units which comprise the main backbone and any branching chains. Preferably the zwitterionic polyamines prior to modification, inter alia, quaternization, substitution of an amino unit hydrogen with an alkyleneoxy unit, have backbones which comprise from 2 to about 100 amino units. The index n which describes the number of backbone units present is further described herein below.

J units are the backbone amino units, said units are selected from the group consisting of:

i) primary amino units having the formula:

$$(R^1)_2N;$$

ii) secondary amino units having the formula:

$$—R^1N;$$

iii) tertiary amino units having the formula:

$$\begin{array}{c} B \\ | \\ —N; \end{array}$$

iv) primary quaternary amino units having the formula:

$$\begin{array}{c} (R^1)_2\overset{+}{N} \\ | \\ Q; \end{array}$$

v) secondary quaternary amino units having the formula:

$$\begin{array}{c} —R^1\overset{+}{N} \\ | \\ Q; \end{array}$$

vi) tertiary quaternary amino units having the formula:

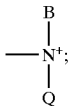

vii) primary N-oxide amino units having the formula:

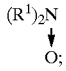

viii) secondary N-oxide amino units having the formula:

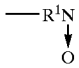

ix) tertiary N-oxide amino units having the formula:

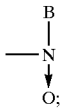

x) and mixtures thereof.

B units which have the formula:

[J—R]— represent a continuation of the zwitterionic polyamine backbone by branching. The number of B units present, as well as, any further amino units which comprise the branches are reflected in the total value of the index n.

The backbone amino units of the zwitterionic polymers are connected by one or more R units, said R units are selected from the group consisting of:

i) $C_2$–$C_{12}$ linear alkylene, $C_3$–$C_{12}$ branched alkylene, or mixtures thereof; preferably $C_3$–$C_6$ alkylene. When two adjacent nitrogens of the polyamine backbone are N-oxides, preferably the alkylene backbone unit which separates said units are $C_4$ units or greater.

ii) alkyleneoxyalkylene units having the formula:

$$—(R^2O)_w(R^3—$$

wherein $R^2$ is selected from the group consisting of ethylene, 1,2-propylene, 1,3-propylene, 1,2-butylene, 1,4-butylene, and mixtures thereof; $R^3$ is $C_2$–$C_8$ linear alkylene, $C_3$–$C_8$ branched alkylene, phenylene, substituted phenylene, and mixtures thereof; the index w is from 0 to about 25. $R^2$ and $R^3$ units may also comprise other backbone units. When comprising alkyleneoxyalkylene units, in one embodiment $R^2$ and $R^3$ units are each preferably ethylene or mixtures of ethylene, propylene and butylene, more preferably ethylene; in another embodiment $R^2$ and $R^3$ units are preferably mixtures of ethylene, propylene and butylene; the index w is from 1, preferably from about 2 to about 10, preferably to about 6.

iii) hydroxyalkylene units having the formula:

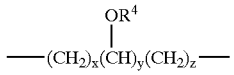

wherein $R^4$ is hydrogen, $C_1$–$C_6$ alkyl, $—(CH_2)_u(R^2O)_t(CH_2)_uY$, and mixtures thereof. When R units comprise hydroxyalkylene units, $R^4$ is preferably hydrogen or $—CH_2)_u(R^2O)_t(CH^2)_uY$ wherein the index t is greater than 0, preferably from 10 to 30; the index u is from 0 to 6; and Y is preferably hydrogen or an anionic unit, more preferably $—SO_3M$. The indices x, y, and z are each independently from 1 to 6, preferably the indices are each equal to 1 and $R^4$ is hydrogen (2-hydroxypropylene unit) or $(R^2O)_tY$, or for polyhydroxy units y is preferably 2 or 3. A preferred hydroxyalkylene unit is the 2-hydroxypropylene unit which can, for example, be suitably formed from glycidyl ether forming reagents, inter alia, epihalohydrin.

iv) hydroxyalkylene/oxyalkylene units having the formula:

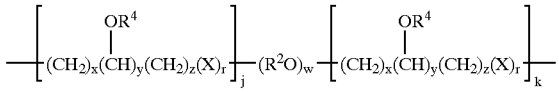

wherein $R^2$, $R^4$, and the indices w, x, y, and z are the same as defined herein above. X is oxygen or the amino unit $—NR^4—$, the index r is 0 or 1. The indices j and k are each independently from 1 to 20. When alkyleneoxy units are absent the index w is 0. Non-limiting examples of preferred hydroxyalkylene/oxyalkylene units have the formula:

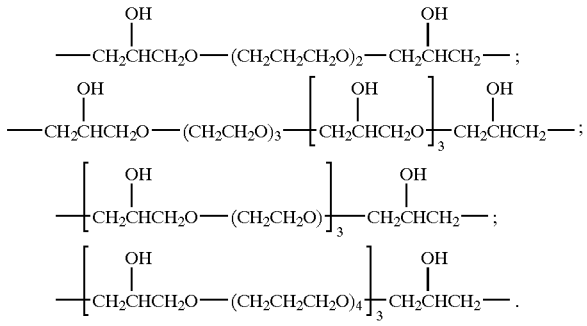

v) carboxyalkyleneoxy units having the formula:

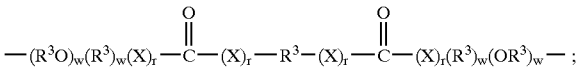

wherein $R^2$, $R^3$, X, r, and w are the same as defined herein above. Non-limiting examples of preferred carboxyalkyleneoxy units include:

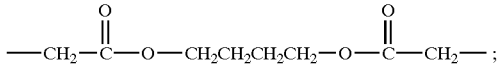

-continued

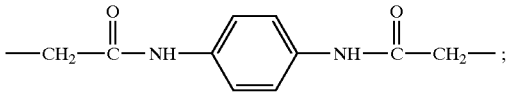

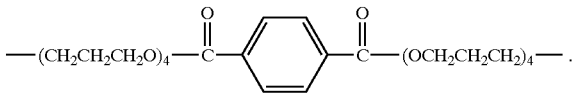

vi) backbone branching units having the formula:

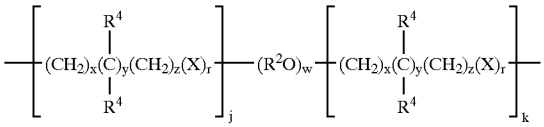

wherein $R^4$ is hydrogen, $C_1$–$C_6$ alkyl, —$CH_2)_u(R^2O)_t(CH_2)_uY$, and mixtures thereof. When R units comprise backbone branching units, $R^4$ is preferably hydrogen or —$CH_2)_u(R^2O)_t$—$(CH_2)_uY$ wherein the index t is greater than 0, preferably from 10 to 30; the index u is from 0 to 6; and Y is hydrogen, $C_1$–$C_4$ linear alkyl, —$N(R^1)_2$, an anionic unit, and mixtures thereof; preferably Y is hydrogen, or —$N(R^1)_2$. A preferred embodiment of backbone branching units comprises $R^4$ equal to —$(R^2O)_tH$. The indices x, y, and z are each independently from 0 to 6.

vii) The formulator may suitably combine any of the above described R units to make a zwitterionic polyamine having a greater or lesser degree of hydrophilic character.

$R^1$ units are the units which are attached to the backbone nitrogens. $R^1$ units are selected from the group consisting of:

i) hydrogen; which is the unit typically present prior to any backbone modification.

ii) $C_1$–$C_{22}$ alkyl, preferably $C_1$–$C_4$ alkyl, more preferably methyl or ethyl, most preferably methyl. A preferred embodiment of the present invention in the instance wherein $R^1$ units are attached to quaternary units (iv) or (v), $R^1$ is the same unit as quaternizing unit Q. For example a J unit having the formula:

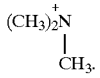

iii) $C_7$–$C_{22}$ arylalkyl, preferably benzyl.

iv) —$[CH_2CH(OR^4)CH_2O]_s(R^2O)_tY$; wherein $R^2$ and $R^4$ are the same as defined herein above, preferably when $R^1$ units comprise $R^2$ units, $R^2$ is preferably ethylene. The value of the index s is from 0 to 5. For the purposes of the present invention the index t is expressed as an average value, said average value from about 0.5 to about 100. The formulator may lightly alkyleneoxylate the backbone nitrogens in a manner wherein not every nitrogen atom comprises an $R^1$ unit which is an alkyleneoxy unit thereby rendering the value of the index t less than 1.

v) Anionic units as described herein below.

vi) The formulator may suitably combine one or more of the above described $R^1$ units when substituting the backbone of the zwitterionic polymers of the present invention.

Q is a quaternizing unit selected from the group consisting of $C_1$–$C_4$ linear alkyl, benzyl, and mixtures thereof, preferably methyl. As described herein above, preferably Q is the same as $R^1$ when $R^1$ comprises an alkyl unit. For each backbone $N^+$ unit (quaternary nitrogen) there will be an anion to provide charge neutrality. The anionic groups of the present invention include both units which are covalently attached to the polymer, as well as, external anions which are present to achieve charge neutrality. Non-limiting examples of anions suitable for use include halogen, inter alia, chloride; methyl sulfate; hydrogen sulfate, and sulfate. The formulator will recognize by the herein described examples that the anion will typically be a unit which is part of the quaternizing reagent, inter alia, methyl chloride, dimethyl sulfate, benzyl bromide.

X is oxygen, —$NR^4$—, and mixtures thereof, preferably oxygen.

Y is hydrogen, $C_1$–$C_4$ linear alkyl, —$N(R^1)_2$, or an anionic unit. Y is —$N(R^1)_2$ preferably when Y is part of an R unit which is a backbone branching unit. Anionic units are defined herein as "units or moieties which are capable of having a negative charge". For example, a carboxylic acid unit, —$CO_2H$, is neutral, however upon de-protonation the unit becomes an anionic unit, —$CO_2^-$, the unit is therefore, "capable of having a negative charge. Non-limiting examples of anionic Y units include —$(CH_2)_fCO_2M$, —$C(O)(CH_2)_fCO_2M$, —$(CH_2)_fPO_3M$, —$(CH_2)_fOPO_3M$, —$(CH_2)_fSO_3M$, —$CH_2(CHSO_3M)$—$(CH_2)_fSO_3M$, —$CH_2(CHSO_2M)(CH_2)_fSO_3M$, —$C(O)CH_2CH(SO_3M)CO_2M$, —$C(O)CH_2CH(CO_2M)NHCH(CO_2M)CH_2CO_2M$, —$C(O)CH_2CH(CO_2M)NHCH_2CO_2M$, —$CH_2CH(OZ)CH_2O(R^1O)_tZ$, —$(CH_2)_fCH[O(R^2O)_tZ]$—$CH_fO(R^2O)_tZ$, and mixtures thereof, wherein Z is hydrogen or an anionic unit non-limiting examples of which include —$(CH_2)_fCO_2M$, —$C(O)(CH_2)_fCO_2M$, —$(CH_2)_fPO_3M$, —$(CH_2)_fOPO_3M$, —$(CH_2)_fO_3M$, —$CH_2(CHSO_3M)$—$(CH_2)_fO_3M$, —$CH_2(CHSO_2M)(CH_2)_fO_3M$, —$C(O)CH_2CH(SO_3M)CO_2M$, —$C(O)CH_2CH(CO_2M)NHCH(CO_2M)CH_2CO_2M$, and mixtures thereof, M is a cation which provides charge neutrality.

Y units may also be oligomeric or polymeric, for example, the anionic Y unit having the formula:

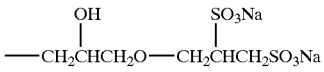

may be oligomerized or polymerized to form units having the general formula:

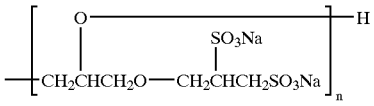

wherein the index n represents a number greater than 1.

Further non-limiting examples of Y units which can be suitably oligomerized or polymerized include:

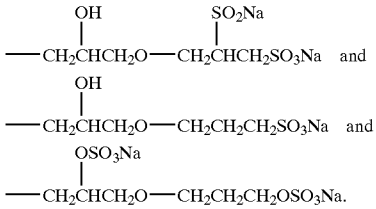

As described herein above that a variety of factors, inter alia, the overall polymer structure, the nature of the formulation, the wash conditions, and the intended target cleaning benefit, all can influence the formulator's optimal values for $Q_r$, $\Delta Q$, and Q(+).

For granular laundry detergent compositions, preferably greater than about 40%, more preferably greater than 50%, yet more preferably more than 75%, most preferably greater than 90% of said Y units are $—SO_3M$ comprising units. However, those skilled in the art will recognize the number of Y units which comprise an anionic unit will vary from embodiment to embodiment depending on the particular wash conditions, surfactants, and adjunct ingredients in the formulation. M is hydrogen, a water soluble cation, and mixtures thereof; the index f is from 0 to 6.

For liquid laundry detergent compositions preferably less than about 90%, more preferably less than 75%, yet more preferably less than 50%, most preferably less than 40% of said Y units comprise an anionic moiety, inter alia, $—SO_3M$ comprising units. The number of Y units which comprise an anionic unit will vary from embodiment to embodiment. M is hydrogen, a water soluble cation, and mixtures thereof; the index f is from 0 to 6.

The index n represents the number of backbone units wherein the number of amino units in the backbone is equal to n+1. For the purposes of the present invention the index n is from 1 to about 99. Branching units B are included in the total number of backbone units.

The following non-limiting examples indicate the manner in which the backbones of the present polyamines are assembled and defined.

The following is an non-limiting example of a backbone according to the present invention prior to quaternization:

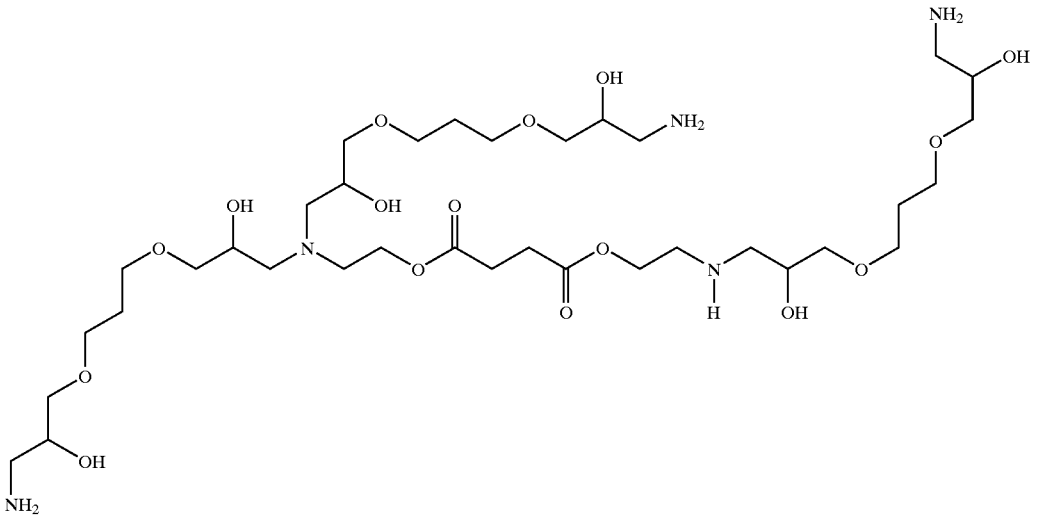

which has an index n equal to 4.

The following is also a non-limiting example of a backbone according to the present invention prior to quaternization:

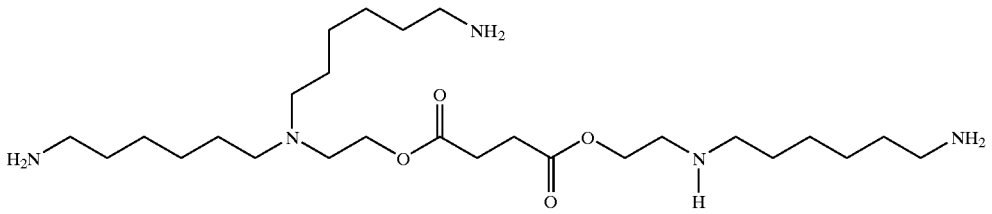

which has an index n equal to 4.

The following is a non-limiting example of a polyamine backbone which is fully quaternized.
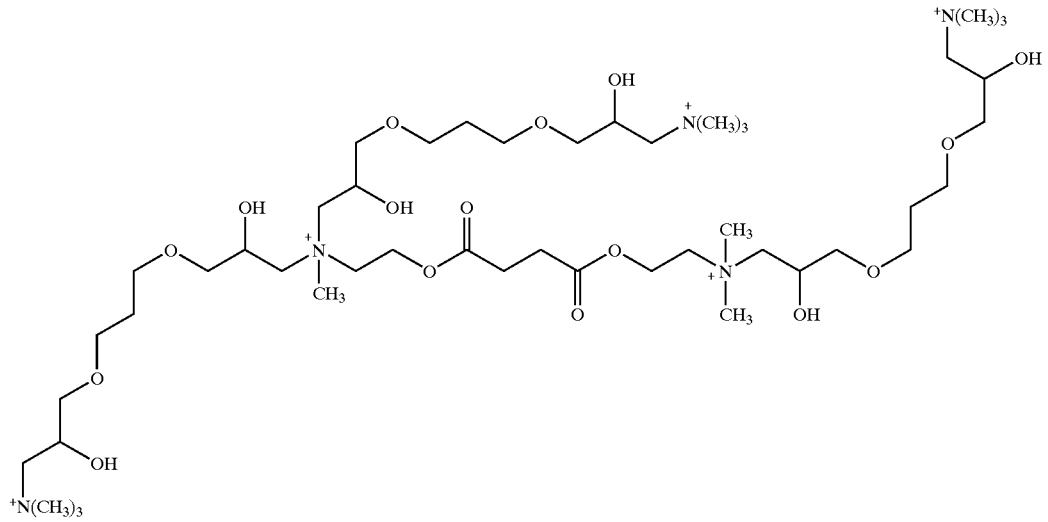
The following is a non-limiting example of a polyamine backbone which is fully quaternized.
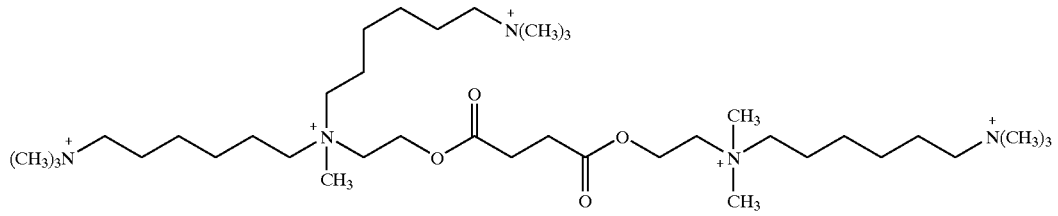
The following is a non-limiting example of a final zwitterionic polyamine according to the present invention.
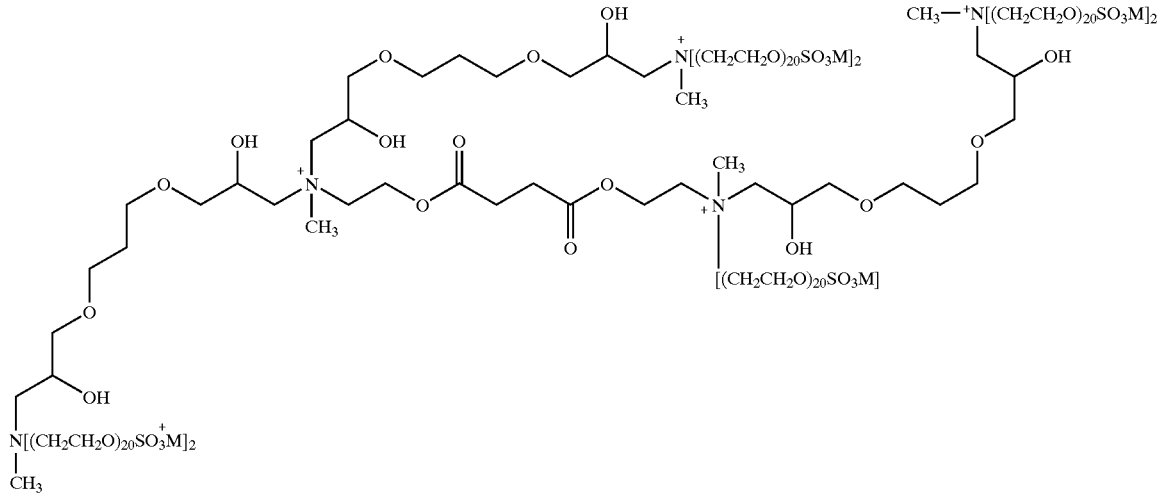

The following is a non-limiting example of a final zwitterionic polyamine according to the present invention.

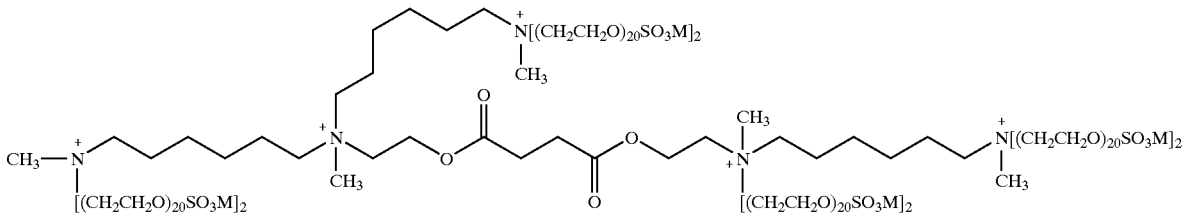

Preferred zwitterionic polymers of the present invention have the formula:

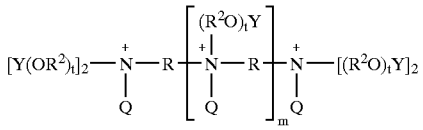

wherein R units have the formula —($R^2$O) $R^3$— wherein $R^2$ and $R^3$ are each independently selected from the group consisting of $C_2$–$C_8$ linear alkylene, $C_3$–$C_8$ branched alkylene, phenylene, substituted phenylene, and mixtures thereof. The $R^2$ units of the formula above, which comprise —($R^2$O)$_t$Y units, are each ethylene; Y is hydrogen, —$SO_3M$, and mixtures thereof, the index t is from 15 to 25; the index m is from 0 to 20, preferably from 0 to 10, more preferably from 0 to 4, yet more preferably from 0 to 3, most preferably from 0 to 2; the index w is from 1, preferably from about 2 to about 10, preferably to about 6.

Non-limiting examples of backbones according to the present invention include 1,9-diamino-3,7-dioxanonane; 1,10-diamino-3,8-dioxadecane; 1,12-diamino-3,10-dioxadodecane; 1,14-diamino-3,12-dioxatetradecane. However, backbones which comprise more than two nitrogens may comprise one or more repeating units having the formula:

$$H_2N—[R—NH]—$$

for example a unit having the formula:

$$H_2N—[CH_2CH_2OCH_2CH_2NH]—$$

is described herein as 1,5-diamino-3-oxapentane. A backbone which comprises two 1,5-diamino-3-oxapentane units has the formula:

$$H_2NCH_2CH_2OCH_2CH_2NHCH_2CH_2OCH_2CH_2NH_2.$$

Further suitable repeating units include 1,8-diamino-3,6-diaxaoctane; 1,11-diamino-3,6,9-trioxaundecane; 1,5-diamino- 1,4-dimethyl-3-oxaheptane; 1,8-diamino-1,4,7-trimethyl-3,6-dioxaoctane; 1,9-diamino-5-oxanonane; 1,14-diamino-5,10-dioxatetradecane.

The present invention affords the formulator with the ability to optimize the zwitterionic polymer for a particular use or embodiment. Not wishing to be limited by theory, it is believed that the backbone quaternization (positive charge carriers) interact with the hydrophilic soils, inter alia, clay, and the anionic capping units of the $R^1$ units ameliorate the ability of surfactant molecules to interact, and therefore occupy, the cationic sites of the zwitterionic polymers. It is surprisingly found that the amount of anionic moieties needed vary from embodiment to embodiment. Heavy Duty Granular (HDG) compositions which comprise a high amount of linear alkylbenzene sulfonate (LAS) surfactant require a greater number of anionic units per se to be present in the zwitterionic polymers. However, unexpectedly, when LAS is substituted for by a branched chain LAS surfactant, the benefit provided by the zwitterionic polymer is enhanced. Preferably, in HDG formulations, the zwitterionic polymer will have a net negative charge. For example, three quaternized backbone nitrogens will be present for every 5—$SO_3M$ capping units.

It is surprisingly found that the liquid laundry detergent compositions (HDL) which encompass the present invention are more effective in releasing hydrophilic soils when the backbones which comprise R units have a greater degree of alkylene unit character and which comprise an excess of backbone quaternary units with respect to the number of anionic units present.

The zwitterionic polymers of the present invention preferably comprise polyamine backbone which are derivatives of two types of backbone units:

i) normal oligomers which comprise R units of type (i), which are preferably polyamines having the formula:

$$H_2N—(CH_2)_x]_{n+1}—[NH—(CH_2)_x]_m—[NB—(CH_2)_x]_n—NH_2$$

wherein B is a continuation of the polyamine chain by branching, n is preferably 0, m is from 0 to 3, x is 2 to 8, preferably from 3 to 6; and ii) hydrophilic oligomers which comprise R units of type (ii), which are preferably polyamines having the formula:

$$H_2N—[(CH_2)_xO]_y(CH_2)_x]—[NH—[(CH_2)_xO]_y(CH_2)_x]_m—NH_2$$

wherein m is from 0 to 3; each x is independently from 2 to 8, preferably from 2 to 6; y is preferably from 1 to 8.

Depending upon the degree of hydrophilic character needed in the zwitterionic backbones, the formulator may assemble higher oligomers from these constituent parts by using R units of types (iii), (iv), and (v). Non-limiting examples include the epihalohydrin condensate having the formula:

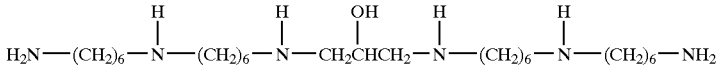

or the hybrid oligomer having the formula:

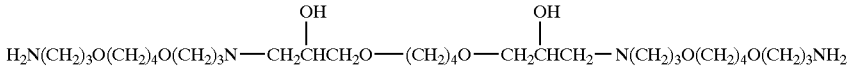

wherein each backbone comprises a mixture of R units.

As described herein before, the formulator may form zwitterionic polymers which have an excess of charge ($Q_r$ less than 1 or greater than 1) or an equivalent amount of charge type ($Q_r$ equal to 1). An example of a preferred zwitterionic polyamine according to the present invention which has an excess of anionic charged units, $Q_r$ equal to 2, has the formula:

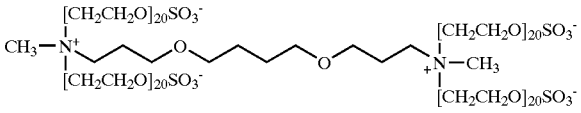

wherein R is a 1,3-propyleneoxy-1,4-butyleneoxy-1,3-propylene unit, w is 2; $R^1$ is —$(R^2O_tY$, wherein $R^2$ is ethylene, each Y is —$SO_3^-$, Q is methyl, m is 0, n is 0, t is 20. For zwitterionic polyamines of the present invention, it will be recognized by the formulator that not every $R^1$ unit will have a —$SO_3^-$ moiety capping said $R^1$ unit. For the above example, the final zwitterionic polyamine mixture comprises at least about 90% Y units which are —$SO_3^-$ units.

As described herein before, the formulator may form zwitterionic polymers which have an excess of charge or an equivalent amount of charge type. An example of a preferred zwitterionic polyamine according to the present invention which has an excess of backbone quaternized units, has the formula:

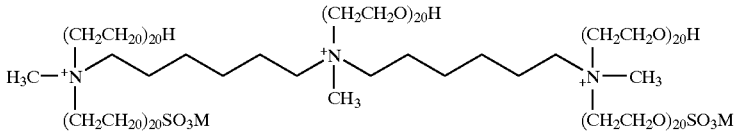

wherein R is a 1,5-hexamethylene, w is 2; $R^1$ is —$(R^2O)_tY$, wherein $R^2$ is ethylene, Y is hydrogen or —$SO_3M$, Q is methyl, m is 1, t is 20. For zwitterionic polyamines of the present invention, it will be recognized by the formulator that not every $R^1$ unit will have a —$SO_3$ moiety capping said $R^1$ unit. For the above example, the final zwitterionic polyamine mixture comprises at least about 40% Y units which are —$SO_3^-$ units.

EXAMPLE 1

Preparation of 4,9-Dioxa-1,12-dodecanediamine, Ethoxylated to Average E20 per NH, Quaternized to 90%, and Sulfated to 90%

Ethoxylation of 4,9-dioxa- 1,12-dodecanediamine to an average of 20 ethoxylations per backbone NH unit. The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide is set up to deliver ethylene oxide as a liquid by a pump to the autoclave with the cylinder placed on a scale so that the weight change of the cylinder can be monitored. A 200 g portion of 4,9-dioxa-1,12-dodecanediamine ("DODD", m.w. 204.32, 97%, 0.95 moles, 1.9 moles N, 3.8 moles ethoxylatable NH's ) is added to the autoclave. The autoclave is then sealed and purged of air (by applying vacuum to minus 28" Hg followed by pressurization with nitrogen to 250 psia, then venting to atmospheric pressure). The autoclave contents are heated to 80° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 167 grams of ethylene oxide (3.8 moles) has been charged to the autoclave, the temperature is increased to 110° C. and the autoclave is allowed to stir for an additional 2 hours. At this point, vacuum is applied to remove any residual unreacted ethylene oxide.

Vacuum is continuously applied while the autoclave is cooled to about 50° C. while introducing 41 g of a 25% sodium methoxide in methanol solution (0.19 moles, to achieve a 10% catalyst loading based upon DODD nitrogen functions). The methoxide solution is removed from the autoclave under vacuum and then the autoclave temperature controller setpoint is increased to 100° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1.5 hours indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 3177 g of ethylene oxide (72.2 mol, resulting in a total of 20 moles of ethylene oxide per mole of ethoxylatable sites on DODD), the temperature is increased to 110° C. and the mixture stirred for an additional 2 hours.

The reaction mixture is then collected into a 22 L three neck round bottomed flask purged with nitrogen. The strong alkali catalyst is neutralized by slow addition of 18.2 g methanesulfonic acid (0.19 moles) with heating (100° C.) and mechanical stirring. The reaction mixture is then removed of residual ethylene oxide and deodorized by sparging an inert gas (argon or nitrogen) into the mixture through a gas dispersion frit while agitating and heating the mixture to 120° C. for 1 hour. The final reaction product is cooled slightly and stored in a glass container purged with nitrogen.

Quaternization of 4,9-dioxa-1,12-dodecanediamine which is ethoxylated to an average of 20 ethoxylations per backbone NH unit Into a weighed, 2000 ml, 3 neck round bottom flask fitted with argon inlet, condenser, addition funnel, thermometer, mechanical stirring and argon outlet (connected to a bubbler) is added DODD EO20 (561.2 g, 0.295 mol N, 98% active, m.w.–3724) and methylene chloride (1000 g) under argon. The mixture is stirred at room temperature until the polymer has dissolved. The mixture is then cooled to 5° C. using an ice bath. Dimethyl sulfate (39.5 g, 0.31 mol, 99%, m.w.–126.13) is slowly added using an addition funnel over a period of 15 minutes. The ice bath is removed and the reaction is allowed to rise to room temperature. After 48 hrs. the reaction is complete.

Sulfation of 4,9-dioxa-1,12-dodecanediamine which is quaternized to about 90% of the backbone nitrogens of the product admixture and which is ethoxylated to an average of 20 ethoxylations per backbone NH unit Under argon, the reaction mixture from the quaternization step is cooled to 5° C. using an ice bath (DODD EO20, 90+mol % quat, 0.59 mol OH). Chlorosulfonic acid (72 g, 0.61 mol, 99%, mw–116.52) is slowly added using an addition funnel. The temperature of the reaction mixture is not allowed to rise above 10° C. The ice bath is removed and the reaction is allowed to rise to room temperature. After 6 hrs. the reaction is complete. The reaction is again cooled to 5° C. and sodium methoxide (264 g, 1.22 mol, Aldrich, 25% in methanol, m.w.–54.02) is slowly added to the rapidly stirred mixture. The temperature of the reaction mixture is not allowed to rise above 10° C. The reaction mixture is transferred to a single neck round bottom flask. Purified water (1300 ml) is added to the reaction mixture and the methylene chloride, methanol and some water is stripped off on a rotary evaporator at 50° C. The clear, light yellow solution is transferred to a bottle for storage. The final product pH is checked and adjusted to ~9 using 1N NaOH or 1N HCl as needed. Final weight ~1753 g.

EXAMPLE 2

Preparation of bis(Hexamethylene)triamine, Ethoxylated to Average E20 per NH, Quaternized to 90%, and Sulfated to 35%.

Ethoxylation of bis(hexamethylene)triamine The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide is set up to deliver ethylene oxide as a liquid by a pump to the autoclave with the cylinder placed on a scale so that the weight change of the cylindercould be monitored.

A 200 g portion of bis(hexamethylene)triamine (BHMT) (M.W. 215.39, high purity 0.93 moles, 2.8 moles N, 4.65 moles ethoxylatable (NH) sites) is added to the autoclave. The autoclave is then sealed and purged of air (by applying vacuum to minus 28" Hg followed by pressurization with nitrogen to 250 psia, then venting to atmospheric pressure). The autoclave contents are heated to 80° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned on and off and cooling is applied to limit any temperature increase resulting from any reaction exotherm. The temperature is maintained between 100 and 110° C. while the total pressure is allowed to gradually increase during the course of the reaction. After a total of 205 grams of ethylene oxide (4.65 moles) has been charged to the autoclave, the temperature is increased to 110° C. and the autoclave is allowed to stir for an additional 2 hours. At this point, vacuum is applied to remove any residual unreacted ethylene oxide.

Vacuum is continuously applied while the autoclave is cooled to about 50° C. while introducing 60.5 g of a 25% sodium methoxide in methanol solution (0.28 moles, to achieve a 10% catalyst loading based upon BHMT nitrogen functions). The methanol from the methoxide solution is removed from the autoclave under vacuum and then the autoclave temperature controller setpoint is increased to 100° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1.5 hours indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 3887 g of ethylene oxide (88.4mol, resulting in a total of 20 moles of ethylene oxide per mol of ethoxylatable sites on BHMT), the temperature is increased to 110° C. and the mixture stirred for an additional 2 hours.

The reaction mixture is then collected into a 22 L three neck round bottomed flask purged with nitrogen. The strong alkali catalyst is neutralized by slow addition of 27.2 g methanesulfonic acid (0.28 moles) with heating (100° C.) and mechanical stirring. The reaction mixture is then purged of residual ethylene oxide and deodorized by sparging an inert gas (argon or nitrogen) into the mixture through a gas dispersion frit while agitating and heating the mixture to 120° C. for 1 hour. The final reaction product is cooled slightly, and poured into a glass container purged with nitrogen for storage.

Quaternization of bis(hexamethylene)triamine which is ethoxylated to an average of 20 ethoxylations per backbone NH unit Into a weighed, 500 ml, 3 neck round bottom flask fitted with argon inlet, condenser, addition funnel, thermometer, mechanical stirring and argon outlet (connected to a bubbler) is added BHMT EO20 (150 g, 0.032 mol, 0.096 mol N, 98% active, m.w.–4615) and methylene chloride (300 g) under argon. The mixture is stirred at room temperature until the polymer has dissolved. The mixture is then cooled to 5° C. using an ice bath. Dimethyl sulfate (12.8 g, 0.1 mol, 99%, m.w.–126.13) is slowly added using an addition funnel over a period of 5 minutes. The ice bath is removed and the reaction is allowed to rise to room temperature. After 48 hrs. the reaction is complete.

Sulfation of bis(hexamethylene)triamine which is quaternized to about 90% of the backbone nitrogens of the product admixture and which is ethoxylated to an average of 20 ethoxylations per backbone NH unit Under argon, the reaction mixture from the quaternization step is cooled to 5° C. using an ice bath (BHMT EO20, 90+mol % quat, 0.16 mol OH). Chlorosulfonic acid (7.53 g, 0.064 mol, 99%, mw–116.52) is slowly added using an addition funnel. The temperature of the reaction mixture is not allowed to rise above 10° C. The ice bath is removed and the reaction is allowed to rise to room temperature. After 6 hrs. the reaction is complete. The reaction is again cooled to 5° C. and sodium methoxide (28.1 g, 0.13 mol, Aldrich, 25% in methanol, m.w.–54.02) is slowly added to the rapidly stirred mixture. The temperature of the reaction mixture is not allowed to rise above 10° C. The reaction mixture is transferred to a single neck round bottom flask. Purified water (500 ml) is added to the reaction mixture and the methylene chloride, methanol and some water is stripped off on a rotary evaporator at 50° C. The clear, light yellow solution is transferred to a bottle for storage. The final product pH is checked and adjusted to ~9 using 1N NaOH or 1N HCl as needed. Final weight, 530 g.

EXAMPLE 3

Preparation of 4,7,10-Trioxa-1,13-tridecanediamine, Ethoxylated to Average E20 per NH, Quaternized to 90%, and Sulfated to 90%.

Ethoxylation of4,7,10-trioxa-1,13-tridecanediamine: The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide is set up to deliver ethylene oxide as a liquid by a pump to the autoclave with the cylinder placed on a scale so that the weight change of the cylinder could be monitored. A 200 g portion of4,7,10-trioxa-1,13-tridecanediamine ($M_w$ 220.31 daltons, 97% 0.9 moles, 1.8 moles N, 3.6 moles ethoxylatable (NH) sites) is charged to the autoclave. The autoclave is then sealed and purged of air (by applying vacuum to minus 28" Hg followed by pressurization with nitrogen to 250 psia, then venting to atmospheric pressure). The autoclave contents are heated to 80° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 158 grams of ethylene oxide (3.6 moles) has been charged to the autoclave, the temperature is increased to 110° C. and the autoclave is allowed to stir for an additional 2 hours. At this point, vacuum is applied to remove any residual unreacted ethylene oxide.

Vacuum is continuously applied while the autoclave is cooled to about 50° C. while introducing 38.9 g of a 25% sodium methoxide in methanol solution (0.18 moles, to achieve a 10% catalyst loading based upon nitrogen functions). The methoxide solution is removed from the autoclave under vacuum and then the autoclave temperature controller setpoint is increased to 100° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1.5 hours indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 3010 g of ethylene oxide (68.4 mol, resulting in a total of 20 moles of ethylene oxide per mole of ethoxylatable sites on TOTD), the temperature is increased to 110° C. and the mixture stirred for an additional 2 hours.

The reaction mixture is then collected into a 22 L three neck round bottomed flask purged with nitrogen. The strong alkali catalyst is neutralized by slow addition of 17.4 g methanesulfonic acid (0.18 moles) with heating (100° C.) and mechanical stirring. The reaction mixture is then removed of residual ethylene oxide and deodorized by sparging an inert gas (argon or nitrogen) into the mixture through a gas dispersion frit while agitating and heating the mixture to 120° C. for 1 hour. The final reaction product is cooled slightly and stored in a glass container purged with nitrogen.

Quaternization 4,7,10-trioxa-1,13-tridecanediamine which has been ethoxylated to an average of 20 ethoxylations per backbone NH unit: Into a weighed, 500 ml, 3 neck round bottom flask fitted with argon inlet, condenser, addition funnel, thermometer, mechanical stirring and argon outlet (connected to a bubbler) is added 4,7,10-trioxa-1,13-tridecanediamine EO20 (150 g, 0.079 mol N, 98% active, m.w.–3740) and methylene chloride (300 g) under argon. The mixture is stirred at room temperature until the polymer has dissolved. The mixture is then cooled to 5° C. using an ice bath.Dimethyl sulfate (10.6 g, 0.083 mol, Aldrich, 99%, $M_{w.}$–126.13) is slowly added by means of a addition funnel over a period of 5 minutes. The ice bath is removed and the reaction is allowed to rise to room temperature. After 48 hrs. the reaction is complete.

Sulfation of 4,7,10-trioxa-1,13-tridecanediamine which is quaternized to about 90% of the backbone nitrogens of the product admixture and which is ethoxylated to an average of 20 ethoxylations per backbone NH unit: Under argon, the reaction mixture from the quaternization step is cooled to 5° C. using an ice bath (4,7,10-trioxa-1,13-tridecanediamine EO20, 90+mol % quat, 0.16 mol OH).Chlorosulfonic acid (20 g, 0.17 mol, mw−116.52) is slowly added using an addition funnel. The temperature of the reaction mixture is not allowed to rise above 10° C. The ice bath is removed and the reaction is allowed to rise to room temperature. After 6 hrs. the reaction is complete. The reaction is again cooled to 5° C. and sodium methoxide (73.5 g, 0.34 mol, Aldrich, 25% in methanol, m.w.−54.02) is slowly added to the rapidly stirred mixture. The temperature of the reaction mixture is not allowed to rise above 10° C. The reaction mixture is transferred to a single neck round bottom flask. Purified water (500 ml) is added to the reaction mixture and the methylene chloride, methanol and some water is stripped off on a rotary evaporator at 50° C. The clear, light yellow solution is transferred to a bottle for storage. The final product pH is checked and adjusted to 9 using 1N NaOH or 1N HCl as needed. Final weight, 550 g.

SURFACTANT SYSTEM

The laundry detergent compositions of the present invention comprise a surfactant system. A required component of the surfactant system is one or more mid-chain branched alkyl sulfate surfactant, one or more mid-chain branched alkyl alkoxy sulfate surfactant, or one or more mid-chain branched aryl sulfonate surfactant. Other anionic surfactants, inter alia, non mid-chain branched sulphonates, sulphates, together with nonionic surfactants, cationic surfactants, zwitterionic surfactants, and ampholytic surfactants may comprise the balance of the surfactant system. The total amount of surfactant present in the compositions is from about 0.01% by weight, preferably from about 0.1% more preferably from about 1% to about 60%, preferably to about 30% by weight, of said composition.

Mid-chain Branched Alkyl Sulfates

The surfactant systems of the present invention may comprise a mid-chain branched alkyl sulfate surfactant and/or a mid-chain branched alkyl alkoxy sulfate surfactant. Because mid-chain branched alkyl sulfate or alkyl alkoxy sulfate surfactants are not required when mid-chain branched aryl sulfonate surfactants are present, the surfactant system comprises from 0%, when present from 0.01%, preferably from about 0.1% more preferably from about 1% to about 100%, preferably to about 80% by weight, preferably to about 60%, most preferably to about 30% by weight, of the surfactant system. When the mid-chain branched alkyl sulfate surfactants or mid-chain branched alkyl alkoxy sulfate surfactants comprise 100% of the surfactant system said surfactants will comprise up to 60% by weight of the final laundry detergent composition.

The mid-chain branched alkyl sulfate surfactants of the present invention have the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_zOSO_3M,$$

the alkyl alkoxy sulfates have the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_z(OR^3)_mOSO_3M,$$

wherein R, $R^1$, and $R^2$ are each independently hydrogen, $C_1$–$C_3$ alkyl, and mixtures thereof; provided at least one of R, $R^1$, and $R^2$ is not hydrogen; preferably R, $R^1$, and $R^2$ are methyl; preferably one of R, $R^1$, and $R^2$ is methyl and the other units are hydrogen. The total number of carbon atoms in the mid-chain branched alkyl sulfate and alkyl alkoxy sulfate surfactants is from 14 to 20; the index w is an integer from 0 to 13; x is an integer from 0 to 13; y is an integer from 0 to 13; z is an integer of at least 1; provided w+x+y+z is from 8 to 14 and the total number of carbon atoms in a surfactant is from 14 to 20; $R^3$ is $C_1$–$C_4$ linear or branched alkylene, preferably ethylene, 1,2-propylene, 1,3-propylene, 1,2-butylene, 1,4-butylene, and mixtures thereof. However, a preferred embodiment of the present invention comprises from 1 to 3 units wherein $R^3$ is 1,2-propylene, 1,3-propylene, or mixtures thereof followed by the balance of the $R^3$ units comprising ethylene units. Another preferred embodiment comprises $R^3$ units which are randomly ethylene and 1,2-propylene units. The average value of the index m is at least about 0.01. When the index m has low values, the surfactant system comprises mostly alkyl sulfates with a small amount of alkyl alkoxy sulfate surfactant. Some tertiary carbon atoms may be present in the alkyl chain, however, this embodiment is not desired.

M denotes a cation, preferably hydrogen, a water soluble cation, and mixtures thereof. Non-limiting examples of water soluble cations include sodium, potassium, lithium, ammonium, alkyl ammonium, and mixtures thereof.

The preferred mid-chain branched alkyl sulfate and alkyl alkoxy sulfate surfactants of the present invention are "substantially linear" surfactants. The term "substantially linear" is defined for the purposes of the present invention as "alkyl units which comprise one branching unit or the chemical reaction products which comprise mixtures of linear (non-branched) alkyl units and alkyl units which comprise one branching unit". The term "chemical reaction products" refers to the admixture obtained by a process wherein substantially linear alkyl units are the desired product but nevertheless some non-branched alkyl units are formed. When this definition is taken together with preferably one of R, $R^1$, and $R^2$ is methyl and the other units are hydrogen, the preferred mid-chain branched alkyl sulfate and alkyl alkoxy sulfate surfactants comprise one methyl branch, preferably said methyl branch is not on the α, β, or the second to the last carbon atom. Typically the branched chains are a mixture of isomers.

The following illustrate preferred examples of mid-chain branched alkyl sulfate and alkoxy alkyl sulfate surfactants.

8-Methylundecyl sulfate:

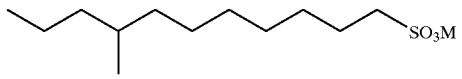

3-Methylundecyl sulfate:

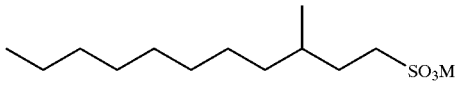

3-Methyltridecyl sulfate:

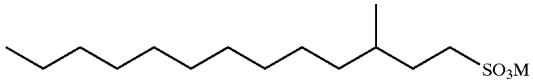

10-Methyltridecyl sulfate:

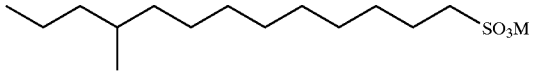

Mid-chain Branched Aryl Sulphonates

The surfactant systems of the present invention may comprise a mid-chain branched aryl sulphonate surfactant. Because mid-chain branched aryl sulfonate surfactants are not required when mid-chain branched alkyl sulfate and/or alkyl alkoxy surfactants are present, the surfactant system comprises from 0%, when present from 0.01%, preferably from about 0.1% more preferably from about 1% to about 100%, preferably to about 80% by weight, preferably to about 60%, most preferably to about 30% by weight, of the surfactant system. When the mid-chain branched aryl sulphonate surfactants comprise 100% of the surfactant system said mid-chain branched aryl sulphonate surfactants will comprise up to 60% by weight of the final laundry detergent composition.

The mid-chain branched aryl sulphonates of the present invention have the formula:

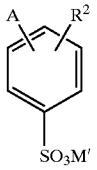

wherein A is a mid-chain branched alkyl unit having the formula:

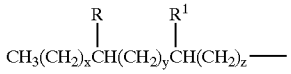

wherein R and $R^1$ are each independently hydrogen, $C_1$–$C_3$ alkyl, and mixtures thereof, provided at least one of R and $R^1$ is not hydrogen; preferably at least one R or $R^1$ is methyl; wherein the total number of carbon atoms in said alkyl unit is from 6 to 18. Some tertiary carbon atoms may be present in the alkyl chain, however, this embodiment is not desired.

The integer x is from 0 to 13. The integer y is from 0 to 13. The integer z is either 0 or 1, preferably 0.

$R^2$ is hydrogen, $C_1$–$C_3$ alkyl, and mixtures thereof. Preferably $R^2$ is hydrogen.

M' denotes a water soluble cation with sufficient charge to provide neutrality, preferably hydrogen, a water soluble cation, and mixtures thereof. Non-limiting examples of water soluble cations include sodium, potassium, lithium, ammonium, alkyl ammonium, and mixtures thereof.

The preferred mid-chain branched aryl sulphonate surfactants of the present invention are "substantially linear aryl" surfactants. The term "substantially linear aryl" is defined for the purposes of the present invention as "an alkyl unit which is taken together with an aryl unit wherein said alkyl unit preferably comprises one branching unit, however, a non-branched linear alkyl unit having an aryl unit bonded to the 2-carbon position as part of an admixture is included as a substantially linear aryl surfactant". The preferred alkyl units do not have a methyl branch on the second to the last carbon atom. Typically the branched chains are a mixture of isomers. However, in the case of the mid-chained branched aryl sulphonates of the present invention, the relative position of the aryl moiety is key to the functionality of the surfactant. Preferably the aryl moiety is attached to the second carbon atom in the branched chain as illustrated herein below.

The preferred mid-chain branched aryl sulphonates of the present invention will comprise a mixture of branched chains. Preferably $R^1$ is methyl, the index z is equal to 0, and the sulphate moiety is para (1,4) to the branched alkyl substituent thereby resulting in a "2-phenyl aryl sulphonate" defined herein by the general formula:

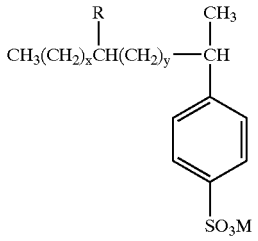

Typically 2-phenyl aryl sulphonates are formed as a mixture together with "3-phenyl aryl sulphonates" defined herein by the general formula:

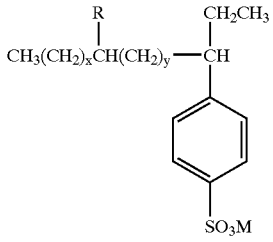

The surfactant properties of the mid-chain branched aryl sulphonates of the present invention can be modified by varying the ratio of 2-phenyl to 3-phenyl isomers in the final surfactant mixture. A convenient means for describing the relative amounts of isomers present is the "2/3 phenyl index" defined herein as "100 times the quotient of the amount of 2-phenyl isomer present divided by the amount of the 3-phenyl isomer which is present". Any convenient means, NMR, inter alia, can be used to determine the relative amounts of isomers present. A preferred 2/3 phenyl index is at least about 275 which corresponds to at least 275 times more 2-phenyl isomer present than the 3-phenyl isomer in the surfactant mixture. The preferred 2/3-phenyl index according to the present invention is from about 275, more preferably from about 350, most preferably from about 500 to about 10,000, preferably to about 1200, more preferably to about 700.

Those of ordinary skill in the art will recognize that the mid-chain branched surfactants of the present invention will be a mixture of isomers and the composition of the mixture will vary depending upon the process which is selected by the formulator to make the surfactants. For example, the following admixture is considered to comprise a substantially linear mid-chain branched aryl sulphonate admixture according to the present invention. Sodium para7-methylnonan-2-yl)benzenesulphonate, sodium para-(6-methylnonan-2-yl)benzenesulphonate, sodium para-(7-methylnonan-3-yl)benzenesulphonate, sodium para-(7-methyldecan-2-yl)benzenesulphonate, sodium para-(7-methylnonanyl)benzenesulphonate.

The following is an illustrative example of an process for preparing a substantially linear mid-chain branched aryl sulfonate.

EXAMPLE 4

Preparation of a Mid-chain Branched Aryl Sulphonate Surfactant Admixture Suitable for use as a Mid-chain Branched Surfactant System An admixture of 2-hexanone (28 g, 0.28 mol), 2-heptanone (28 g, 0.25 mol), and 2-octanone (14 g, 0.11 mol) in anhydrous diethyl ether (100 g) is charged to an addition funnel. The ketone admixture is added dropwise over a period of 1.75 hours to a nitrogen blanketed, mechanically stirred three neck round bottom flask, fitted with a reflux condenser containing a 2.0 M solution of hexylmagnesium bromide (350 mL) in diethyl ether further diluted with additional anhydrous diethyl ether (100 mL). After the addition is complete, the reaction mixture is stirred an additional 1 hour at 20° C. The reaction mixture is then added to 600 g of a mixture of ice and water with stirring. To this solution is added a 30% sulfuric acid solution (228.6 g). The resulting two liquid phases are added to a separatory funnel. The aqueous layer is removed and the organic phase is extracted twice with water (600 mL). The organic layer is dried and the solvent removed in vacuo to yield 115.45 g of the desired alcohol mixture.

A portion of the alcohol mixture (100 g) is charged to a glass autoclave liner together with benzene (300 mL) and a shape selective zeolite catalyst (acidic mordenite catalyst Zeocat™ FM-8/25H) (20 g). The glass liner is fitted into a stainless steel, rocking autoclave. The autoclave system is purged twice with 250 psig $N_2$, and then charged to 1000 psig $N_2$. With mixing, the solution is heated to 170° C. for 14–15 hours. After cooling, the reaction product is filtered to remove catalyst and concentrated by distilling off any excess benzene. A mixture of a "lightly branched olefin mixture" is obtained.

A portion of the lightly branched olefin mixture (50 g) is charged to a glass autoclave liner. Benzene (150 mL) and a shape selective zeolite catalyst (acidic mordenite catalyst Zeocat™ FM-8/25H) (10 g) are added. The glass liner is placed inside a stainless steel, rocking autoclave. The autoclave is purged twice with 250 psig $N_2$, and then charged to 1000 psig $N_2$. With mixing, the solution is heated to 195° C. for 14–15 hours. After cooling the reaction product is filtered to remove catalyst and concentrated by distilling off any excess benzene. A clear liquid product is obtained. The product is distilled under vacuum (1–5 mm of Hg) to afford a fraction which distills from 95° C.–135° C. containing the desired "lightly branched alkylbenzene" admixture.

The lightly branched alkylbenzene fraction is treated with a molar equivalent of $SO_3$, the resulting product is neutralized with sodium methoxide in methanol, and the methanol evaporated to give a mid-chain branched aryl sulphonate surfactant admixture which can be directly used in the surfactant system of the present invention.

Optional Surfactants

The laundry detergent compositions of the present invention may optionally comprise at least about 0.01% by weight, preferably from about 0.1% to about 90%, preferably to about 60% more preferably to about 30% by weight, of the surfactant system, a non mid-chain branched alkyl sulfate or non-mid chain branched aryl sulphonate surfactant. Depending upon the embodiment of the present invention one or more categories of surfactants may be chosen by the formulator. Preferred categories of surfactants are selected from the group consisting of anionic, cationic, nonionic, zwitterionic, ampholytic surfactants, and mixtures thereof. Within each category of surfactant, more than one type of surfactant of surfactant can be selected. For example, preferably the solid (i.e. granular) and viscous semi-solid (i.e. gelatinous, pastes, etc. ) systems of the present invention, surfactant is preferably present to the extent of from about 0.1% to 60%, preferably to about 30% by weight of the composition.

Non-limiting examples of surfactants useful herein include:

a) $C_{11}$–$C_{18}$ alkyl benzene sulphonates (LAS);

b) $C_{10}$–$C_{20}$ primary, branched-chain and random alkyl sulfates (AS);

c) $C_{10}$–$C_{18}$ secondary (2,3) alkyl sulfates having the formula:

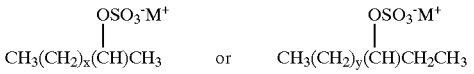

wherein x and (y+1) are integers of at least about 7, preferably at least about 9; said surfactants disclosed in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

d) $C_{10}$–$C_{18}$ alkyl alkoxy sulfates (AEXS) wherein preferably x is from 1–7;

e) $C_{10}$–$C_{18}$ alkyl alkoxy carboxylates preferably comprising 1–5 ethoxy units;

f) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated herein by reference;

g) Alkylpolysaccharides as disclosed in U.S. Pat. No. 4,565,647 Llenado, issued Jan. 26, 1986, incorporated herein by reference;

h) Polyhydroxy fatty acid amides having the formula:

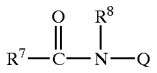

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof, preferred alkoxy is ethoxy or propoxy, and mixtures thereof; preferred Q is derived from a reducing sugar in a reductive amination reaction, more preferably Q is a glycityl moiety; Q is more preferably selected from the group consisting of $—CH_2(CHOH)_n CH_2OH$, $—CH(CH_2OH)(CHOH)_{n-1}CH_2OH$, $—CH_2(CHOH)_2—(CHOR')(CHOH)CH_2OH$, and alkoxylated derivatives thereof, wherein n is an integer from 3 to 5, inclusive, and $R^1$ is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

BLEACHING SYSTEM

The clay soil removal laundry detergent compositions of the present invention may optionally comprise a bleaching system. Bleaching systems typically comprise a "bleaching agent" (source of hydrogen peroxide) and an "initiator" or "catalyst".

Compositions of the present invention which comprise a bleaching system, comprise:

a) from about 0.01% by weight of a zwitterionic polyamine according to the present invention;

b) from about 0.01% by weight, of a surfactant system comprising:
   i) from 0% to 80% by weight, of a mid-chain branched alkyl sulfate surfactant;
   ii) from 0% to 80% by weight, of a mid-chain branched aryl sulfonate surfactant;
   iii) optionally from 0.01% by weight, of a surfactant selected from the group consisting of anionic, nonionic, cationic, zwitterionic, ampholytic surfactants, and mixtures thereof;

c) from about 1%, preferably from about 5% to about 80%, preferably to about 50% by weight, of a peroxygen bleaching system comprising:
   i) from about 40%, preferably from about 50%, more preferably from about 60% to about 100%, preferably to about 95%, more preferably to about 80% by weight, of the bleaching system, a source of hydrogen peroxide;
   ii) optionally from about 0.1%, preferably from about 0.5% to about 60%, preferably to about 40% by weight, of the beaching system, a beach activator;
   iii) optionally from about 1 ppb (0.0000001%), more preferably from about 100 ppb (0.00001%), yet more preferably from about 500 ppb (0.00005%), still more preferably from about 1 ppm (0.0001%) to about 99.9%, more preferably to about 50%, yet more preferably to about 5%, still more preferably to about 500 ppm (0.05%) by weight of the composition, of a transition-metal bleach catalyst;
   iv) optionally from about 0.1% by weight, of a preformed peroxygen bleaching agent; and d) the balance carriers and other adjunct ingredients.

Bleaching Agents—Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

Sources of hydrogen peroxide which are suitable for use in the compositions of the present invention include, but are not limited to, perborates, percarbonates, perphosphates, persulfates, and mixtures thereof. Preferred sources of hydrogen peroxide are sodium perborate monohydrate, sodium perborate tetrahydrate, sodium percarbonate and sodium persulfate, more preferably are sodium perborate monohydrate, sodium perborate tetrahydrate, and sodium percarbonate. When present the source of hydrogen peroxide is present at a level of from about 40%, preferably from about 50%, more preferably from about 60% to about 100%, preferably to about 95%, more preferably to about 80% by weight, of the bleaching system. Embodiments which are bleach comprising pre-soak compositions may comprise from 5% to 99% of the source of hydrogen peroxide.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants.

Bleach Activators

Preferably, the source of hydrogen peroxide (peroxygen bleach component) in the composition is formulated with an activator (peracid precursor). The activator is present at levels of from about 0.01%, preferably from about 0.5%, more preferably from about 1% to about 15%, preferably to about 10%, more preferably to about 8%, by weight of the composition. Also, bleach activators will comprise from about 0.1% to about 60% by weight, of the beaching system. When the herein described bleaching system comprises 60% by weight, of an activator (the maximal amount) and said composition (bleaching composition, laundry detergent, or otherwise) comprises 15% by weight of said activator (the maximal amount by weight), said composition will comprise 25% by weight of a bleaching system (60% of which is bleach activator, 40% a source of hydrogen peroxide). However, this is not meant to restrict the formulator to a 60:40 ratio of activator to hydrogen peroxide source.

Preferably the mole ratio of peroxygen bleaching compound (as AvO) to bleach activator in the present invention generally ranges from at least 1:1, preferably from about 20:1, more preferably from about 10:1 to about 1:1, preferably to about 3:1.

Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-(nonaoyl) amino hexanoyloxy]-benzene sulfonate sodium salt (NACA-OBS) an example of which is described in U.S. Pat. No. 5,523,434, dodecanoyloxybenzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey ct al., issued Nov. 11, 1997; U.S. Pat. No. 5,686,014 Hartshorn et al., issued Nov. 11, 1997: U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel el al., issued Jul. 14, 1992; and U.S. Pat. No. 4,412,934 Chung et al., issued Nov. 1, 1983, and WO 94128104: acyl lactam activators, as described in U.S. Pat. No. 5,698,504, U.S. Pat. No. 5,695,679 and U.S. Pat. No. 5,686,014, each of which is cited herein above, are very useful herein, especially the acyl caprolactams (see for example WO 04-28102 A) and acyl valerolactaims, U.S. Pat. No. 5,503,639 Willey et al., issued Apr. 2, 1996 all of which are incorporated herein by reference.

Quaternary substituted bleach activators may also be included. The present cleaning compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle etal., issued Dec. 17, 1996; and U.S. Pat. No. 5,578,136 Tayloretal., issued Nov. 26, 1996; all of which are incorporated herein by reference.

Highly preferred bleach activators useful herein are amide-substituted as described in U.S. Pat. No. 5,698,504, U.S. Pat. No. 5,695,679, and U.S. Pat. No. 5,686,014 each of which are cited herein above. Preferred examples of such bleach activators include: (6-octanamidocaproyl) oxybenzenesulfonate, (6-nonanarnidocaproyl) oxybenzenesulfonate, (6-decanamidocaproyl) oxybenzenesulfonate and mixtures thereof.

Other useful activators, disclosed in U.S. Pat. No. 5,698, 504, U.S. Pat. No. 5,695,679, U.S. Pat. No. 5,686,014 each of which is cited herein above and U.S. Pat. No. 4,966,723 Hodge et al., issued Oct. 30, 1990, include benzoxazin-type activators, such as a $C_6H_4$ ring to which is fused in the 1,2-positions a moiety —C(O)OC($R^1$)═N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Transition Metal Bleach Catalyst

The laundry detergent compositions of the present invention optionally comprises a bleaching system which contains one or more bleach catalysts. Selected bleach catalysts inter alia 5,12-dimethyl-1,5,8,12-tertaaza-bicyclo[6.6.2] hexadecane manganese (II) chloride may be formulated into bleaching systems which do not require a source of hydrogen peroxide or peroxygen bleach. The compositions comprise from about 1 ppb (0.0000001%), more preferably from about 100 ppb (0.00001%), yet more preferably from about 500 ppb (0.00005%), still more preferably from about 1 ppm (0.0001%) to about 99.9%, more preferably to about 50%, yet more preferably to about 5%, still more preferably to about 500 ppm (0.05%) by weight of the composition, of a transition-metal bleach catalyst Non-limiting examples of suitable manganese-based catalysts are disclosed in U.S. Pat. No. 5,576,282 Miracle et al., issued Nov. 19, 1996; U.S. Pat. No. 5,246,621 Favre et al., issued Sep. 21, 1993; U.S. Pat. No. 5,244,594 Favre et al., issued Sep. 14, 1993; U.S. Pat. No. 5,194,416 Jureller et al., issued Mar. 16, 1993; U.S. Pat. No. 5,114,606 van Vliet et al., issued May 19, 1992; U.S. Pat. No. 4,430,243 Bragg, issued Feb. 7, 1984; U.S. Pat. No. 5,114,611 van Kralingen, issued May 19, 1992; U.S. Pat. No. 4,728,455 Rerek, issued Mar. 1, 1988; U.S. Pat. No. 5,284,944 Madison, issued Feb. 8, 1994; U.S. Pat. No. 5,246,612 van Dijk et al., issued Sept. 21, 1993; U.S. Pat. No. 5,256,779 Kerschner et al., issued Oct. 26, 2993; U.S. Pat. No. 5,280,117 Kerschner et al., issued Jan. 18, 1994; U.S. Pat. No. 5,274,147 Kerschner et al., issued Dec. 28, 1993; U.S. Pat. No. 5,153,161 Kerschner et al., issued Oct. 6, 1992; and U.S. Pat. No. 5,227,084 Martens et al., issued Jul. 13, 1993; and European Pat. App. Pub. Nos. 549,271 A1, 549,272 A1, 544,440 A2, and 544, 490 A1.

Non-limiting examples of suitable cobalt-based catalysts are disclosed in U.S. Pat. No. 5,597,936 Perkins et al., issued Jan. 28, 1997; U.S. Pat. No. 5,595,967 Miracle et al., issued Jan. 21, 1997; U.S. Pat. No. 5,703,030 Perkins et al., issued Dec. 30, 1997; U.S. Pat. No. Pat. 4,810,410 Diakun et al, issued Mar. 7,1989; M. L. Tobe, "Base Hydrolysis of Transition-Metal Complexes", *Adv. Inorg. Bioinorg. Mech.*, (1983), 2, pages 1–94; *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.*, 18, 1497–1502 (1979); *Inorg. Chem.*, 21, 2881–2885 (1982); *Inorg. Chem.,* 18, 2023–2025 (1979); Inorg. Synthesis, 173–176 (1960); and *Journal of Physical Chemistry*. 56, 22–25 (1952).

Further examples of preferred macrocyclic ligand comprising bleach catalysts are described in WO 98/39406 A1 published Sep. 11, 1998 and included herein by reference. Suitable examples of these bleach catalysts include:

- Dichloro-5,12dimethyl-1,5,8,12-tetraazabicyclo[6.6.2] hexadecane manganese(II)
- Diaquo-5,12-dimethyl-1,5,8,12-tetraazabicyclo[6.6.2] hexadecane manganese(II) hexafluorophosphate
- Aquo-hydroxy-5,12-dimethyl-1,5,8,12-tetraazabicyclo [6.6.2]hexadecane manganese(III) hexafluorophosphate
- Diaquo-5,12-dimethyl-1,5,8,12-tetraazabicyclo[6.6.2] hexadecane manganese(II) tetrafluoroborate
- Dichloro-5,12-dimethyl-1,5,8,12-tetraazabicyclo[6.6.2] hexadecane manganese(III) hexafluorophosphate
- Dichloro-5,12-di-n-butyl-1,5,8,12-tetraaza bicyclo[6.6.2] hexadecane manganese(II)
- Dichloro-5,12dibenzyl-1,5,8,12-tetraazabicyclo[6.6.2] hexadecane manganese(II)
- Dichloro-5-n-butyl-12-methyl-1,5,8,12-tetraaza-bicyclo [6.6.2]hexadecane manganese(II)
- Dichloro-5-n-octyl-12-methyl-1,5,8,12-tetraaza-bicyclo [6.6.2]hexadecane manganese(II)
- Dichloro-5-n-butyl-12-methyl-1,5,8,12-tetraaza-bicyclo [6.6.2]hexadecane manganese(II).

Pre-formed Bleaching Agents

The bleaching systems of the present invention may optionally further comprise from 0.1%, preferably from 1%, more preferably from 5% to about 10%, preferably to about 7% by weight, of one or more pre-formed bleaching agents. Pre-formed bleaching materials typically have the general formula:

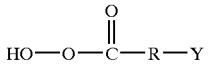

wherein R is a $C_{14}$–$C_{22}$ alkylene, $C_1$–$C_{22}$ substituted alkylene, phenylene, $C_6$–$C_{22}$ substituted phenylene, and mixtures thereof, Y is hydrogen, halogen, alkyl, aryl, —C(O)OH, —C(O)OOH, and mixtures thereof.

The organic percarboxylic acids usable in the present invention can contain either one or two peroxy groups and can be either aliphatic or aromatic. When the organic percarboxylic acid is aliphatic, the unsubstituted acid has the general formula:

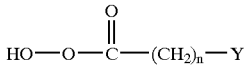

wherein Y can be hydrogen, methyl, methyl chloride, carboxylate, percarboxylate; and n is an integer having the value from 1 to 20.

When the organic percarboxylic acid is aromatic, the unsubstituted acid has the general formula:

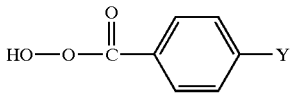

wherein Y can be hydrogen, alkyl, haloalkyl, carboxylate, percarboxylate, and mixtures thereof.

Typical monoperoxy percarboxylic acids useful herein include alkyl percarboxylic acids and aryl percarboxylic acids such as:

i) peroxybenzoic acid and ring-substituted peroxybenzoic acids, e.g., peroxy-o-naphthoic acid;

ii) aliphatic, substituted aliphatic and arylalkyl monoperoxy acids, e.g. peroxylauric acid, peroxystearic acid, and N,N-phthaloylaminoperoxycaproic acid (PAP).

Typical diperoxy percarboxylic acids useful herein include alkyl diperoxy acids and aryldiperoxy acids, such as:

iii) 1,12diperoxydodecanedioic acid;

iv) 1,9-diperoxyazelaic acid;

v) diperoxybrassylic acid; diperoxysebacic acid and diperoxyisophthalic acid;

vi) 2-decyldiperoxybutane-1,4-dioic acid;

vii) 4,4'-sulfonybisperoxybenzoic acid.

A non-limiting example of a highly preferred pre-formed bleach includes 6-nonylamino-6-oxoperoxycaproic acid (NAPAA) as described in U.S. Pat. No. 4,634,551 Bums et al., issued Jan. 6, 1987 included herein by reference.

As well as the herein described peroxygen bleaching compositions, the compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

ENZYME SYSTEMS

"Detersive enzyme", as used herein, means any enzyme having a cleaning, stain removing or otherwise beneficial effect in a liquid laundry, hard surface cleaning or personal care detergent composition. Preferred detersive enzymes are hydrolases such as proteases, amylases and lipases. Preferred enzymes for liquid laundry purposes include, but are not limited to, inter alia proteases, cellulases, lipases and peroxidases. Typically enzymes are present in an amount from about 0.001% (10 ppm), preferably from 0.005% (50 ppm) to about 0.1% (1000 ppm), preferably to about 0.05% (500 ppm). However, the amount of an enzyme which is present is also predicated on the presence of other enzymes in the compositions. For example, protease enzymes can be formulated with amylase enzymes or other protease enzymes and this will have an impact on the amount of enzyme present.

Protease Enzymes

The preferred liquid laundry detergent compositions according to the present invention further comprise at least 0.001% by weight, of a protease enzyme. However, an effective amount of protease enzyme is sufficient for use in the liquid laundry detergent compositions described herein. The term "an effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. The protease enzymes of the present invention are usually present in such commercial preparations at levels sufficient to provide from 0.005 to 0.1 Anson units (AU) of activity per gram of composition.

Preferred liquid laundry detergent compositions of the present invention comprise modified protease enzymes derived from *Bacillus amyloliquefaciens* or *Bacillus lentus*. For the purposes of the present invention, protease enzymes derived from *B. amyloliquefaciens* are further referred to as "subtilisin BPN"" also referred to as "Protease A" and protease enzymes derived from *B. Lentus* are further referred to as "subtilisin 309". For the purposes of the present invention, the numbering of *Bacillus amyloliquefaciens* subtilisin, as described in the patent applications of A. Baeck, et al, entitled "ProteaseContaining Cleaning Compositions" having U.S. Ser. No. 08/322,676, serves as the amino acid sequence numbering system for both subtilisin BPN' and subtilisin 309.

Derivatives of *Bacillus amyloliquefaciens* Subtilisin-BPN' Enzymes

A preferred protease enzyme for use in the present invention is a variant of Protease A (BPN') which is a non-naturally occurring carbonyl hydrolase variant having a different proteolytic activity, stability, substrate specificity, pH profile and/or performance characteristic as compared to the precursor carbonyl hydrolase from which the amino acid sequence of the variant is derived. This variant of BPN' is disclosed in EP 130,756 A, Jan. 9, 1985. Specifically Protease A-BSV is BPN' wherein the Gly at position 166 is replaced with Asn, Ser, Lys, Arg, His, Gln, Ala, or Glu; the Gly at position 169 is replaced with Ser; the Met at position 222 is replaced with Gln, Phe, Cys, His, Asn, Glu, Ala or Thr; or alternatively the Gly at position 166 is replaced with Lys, and the Met at position 222 is replaced with Cys; or alternatively the Gly at position 169 is replaced with Ala and the Met at position 222 is replaced with Ala.

Protease B

A preferred protease enzyme for use in the present invention is Protease B. Protease B is a non-naturally occurring carbonyl hydrolase variant having a different proteolytic activity, stability, substrate specificity, pH profile and/or performance characteristic as compared to the precursor carbonyl hydrolase from which the amino acid sequence of the variant is derived. Protease B is a variant of BPN' in which tyrosine is replaced with leucine at position +217 and as further disclosed in EP 303,761 A, Apr. 28, 1987 and EP 130,756 A, Jan. 9, 1985.

Bleach Stable Variants of Protease B (Protease B-BSV)

A preferred protease enzyme for use in the present invention are bleach stable variants of Protease B. Specifically Protease B-BSV are variants wherein the Gly at position 166 is replaced with Asn, Ser, Lys, Arg, His, Gln, Ala, or Glu; the Gly at position 169 is replaced with Ser; the Met at position 222 is replaced with Gln, Phe, Cys, His, Asn, Glu, Ala or Thr; or alternatively the Gly at position 166 is replaced with Lys, and the Met at position 222 is replaced with Cys; or alternatively the Gly at position 169 is replaced with Ala and the Met at position 222 is replaced with Ala.

Surface Active Variants of Protease B

Preferred Surface Active Variants of Protease B comprise BPN' wild-type amino acid sequence in which tyrosine is replaced with leucine at position +217, wherein the wild-type amino acid sequence at one or more of positions 199, 200, 201, 202, 203, 204, 205, 206, 207, 208, 209, 210, 211, 212, 213, 214, 215, 216, 218, 219 or 220 is substituted; wherein the BPN' variant has decreased adsorption to, and increased hydrolysis of, an insoluble substrate as compared to the wild-type subtilisin BPN'. Preferably, the positions having a substituted amino acid are 199, 200, 201, 202, 205, 207, 208, 209, 210, 211, 212, or 215; more preferably, 200, 201, 202, 205 or 207.

Also preferred proteases derived from *Bacillus amyloliquefaciens* subtilisin are subtilisin BPN' enzymes that have been modified by mutating the various nucleotide sequences that code for the enzyme, thereby modifying the amino acid sequence of the enzyme. These modified subtilisin enzymes have decreased adsorption to and increased hydrolysis of an insoluble substrate as compared to the wild-type subtilisin. Also suitable are mutant genes encoding for such BPN' variants.

Derivatives of Subtilisin 309

Further preferred protease enzymes for use according to the present invention also include the "subtilisin 309" variants. These protease enzymes include several classes of subtilisin 309 variants described herein below.

Protease C

A preferred protease enzyme for use in the compositions of the present invention Protease C. Protease C is a variant of an alkaline serine protease from Bacillus in which lysine replaced arginine at position 27, tyrosine replaced valine at position 104, serine replaced asparagine at position 123, and arginine replaced threonine at position 274. Protease C is described in EP 90915958:4, corresponding to WO 91/06637, Published May 16, 1991. Genetically modified variants, particularly of Protease C, are also included herein.

Protease D

A preferred protease enzyme for use in the present invention is Protease D. Protease D is a carbonyl hydrolase variant derived from *Bacillus lentus* subtilisin having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International.

A. Loop Region 6 Substitution Variants—These subtilisin 309-type variants have a modified amino acid sequence of subtilisin 309 wild-type amino acid sequence, wherein the modified amino acid sequence comprises a substitution at one or more of positions 193, 194, 195, 196, 197, 199, 200, 201, 202, 203, 204, 205, 206, 207, 208, 209, 210, 211, 212, 213 or 214; whereby the subtilisin 309 variant has decreased adsorption to, and increased hydrolysis of, an insoluble substrate as compared to the wild-type subtilisin 309. Preferably these proteases have amino acids substituted at 193, 194, 195, 196, 199, 201, 202, 203, 204, 205, 206 or 209; more preferably 194, 195, 196, 199 or 200.

B. Multi-Loop Regions Substitution Variants—These subtilisin 309 variants may also be a modified amino acid sequence of subtilisin 309 wild-type amino acid sequence, wherein the modified amino acid sequence comprises a substitution at one or more positions in one or more of the first, second, third, fourth, or fifth loop regions; whereby the subtilisin 309 variant has decreased adsorption to, and increased hydrolysis of, an insoluble substrate as compared to the wild-type subtilisin 309.

C. Substitutions at positions other than the loop regions—In addition, one or more substitution of wild-type subtilisin 309 may be made at positions other than positions in the loop regions, for example, at position 74. If the additional substitution to the subtilisin 309 is mad at position 74 alone, the substitution is preferably with Asn, Asp, Glu, Gly, His, Lys, Phe or Pro, preferably His or Asp. However modifications can be made to one or more loop positions as well as position 74, for example residues 97, 99, 101, 102, 105 and 121.

Subtilisin BPN' variants and subtilisin 309 variants are further described in WO 95/29979, WO 95/30010 and WO 95/30011, all of which were published Nov. 9, 1995, all of which are incorporated herein by reference.

A further preferred protease enzyme for use in combination with the modified polyamines of the present invention is ALCALASE® from Novo. Another suitable protease is obtained from a strain of Bacillus, having maximum activity throughout the pH range of 8–12, developed and sold as ESPERASE® by Novo Industries A/S of Derunark, hereinafter "Novo". The preparation of this enzyme and analogous enzymes is described in GB 1,243,784 to Novo. Other suitable proteases include SAVINASE® from Novo and MAXATASE® from 1 nternational Bio-Synthetics, Inc., The Netherlands. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble. When desired, a protease having decreased adsorption and increased hydrolysis is available as described in WO 9507791 to Procter & Gamble. A recombinant trypsin-like protease for detergents suitable herein is described in WO 9425583 to Novo.

Other particularly useful proteases are multiply-substituted protease variants comprising a substitution of an amino acid residue with another naturally occurring amino acid residue at an amino acid residue position corresponding to position 103 of *Bacillus amyloliquefaciens* subtilisin in combination with a substitution of an amino acid residue with another naturally occurring amino acid residue at one or more amino acid residue positions corresponding to positions 1, 3, 4, 8, 9, 10, 12, 13, 16, 17, 18, 19, 20, 21, 22, 24, 27, 33, 37, 38, 42, 43, 48, 55, 57, 58, 61, 62, 68, 72, 75, 76, 77, 78, 79, 86, 87, 89, 97, 98, 99, 101, 102, 104, 106, 107, 109, 111, 114, 116, 117, 119, 121, 123, 126, 128, 130, 131, 133, 134, 137, 140, 141, 142, 146, 147, 158, 159, 160, 166, 167, 170, 173, 174, 177, 181, 182, 183, 184, 185, 188, 192, 194, 198, 203, 204, 205, 206, 209, 210, 211, 212, 213, 214, 215, 216, 217, 218, 222, 224, 227, 228, 230, 232, 236, 237, 238, 240, 242, 243, 244, 245, 246, 247, 248, 249, 251, 252, 253, 254, 255, 256, 257, 258, 259, 260, 261, 262, 263, 265, 268, 269, 270, 271, 272, 274 and 275 of *Bacillus amyloliquefaciens* subtilisin; wherein when said protease variant includes a substitution of amino acid residues at positions corresponding to positions 103 and 76, there is also a substitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin and/or multiply-substituted protease variants comprising a substitution of an amino acid residue with another naturally occurring amino acid residue at one or more amino acid residue positions corresponding to positions 62, 212, 230, 232, 252 and 257 of *Bacillus amyloliquefaciens* subtilisin as described in WO 99/20727, WO 99/20726, and WO 99/20723.

Also suitable for the present invention are proteases described in patent applications EP 251 446 and WO 91/06637, protease BLAP® described in W091/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

Commercially available proteases useful in the present invention are known as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of The Netherlands).

In addition to the above-described protease enzymes, other enzymes suitable for use in the liquid laundry detergent compositions of the present invention are further described herein below.

Other Enzymes

Enzymes in addition to the protease enzyme can be included in the present detergent compositions for a variety of purposes, including removal of protein-based, carbohydrate-based, or triglyceride-based stains from surfaces such as textiles, for the prevention of refugee dye transfer, for example in laundering, and for fabric restoration. Suitable enzymes include amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from about 0.001%, preferably from about 0.01% to about 5%, preferably to about 1% by weight of a commercial enzyme preparation. Protease enzymes are usually present in such commercial preparations at levels sufficient to provide from 0.005 to 0.1 Anson units (AU) of activity per gram of composition. For certain detergents, it may be desirable to increase the active enzyme content of the commercial preparation in order to minimize the total amount of non-catalytically active materials and thereby improve spotting/filming or other end-results. Higher active levels may also be desirable in highly concentrated detergent formulations.

Amylases suitable herein include, for example, α-amylases described in GB 1,296,839 to Novo; RAPIDASE®, International Bio-Synthetics, Inc. and TERMAMYL®, Novo. FUTNGAMYL® from Novo is especially useful. Engineering of enzymes for improved stability, e.g., oxidative stability, is known. See, for example J. Biological Chem., Vol. 260, No. 11, June 1985, pp 6518–6521. Certain preferred embodiments of the present compositions can make use of amylases having improved stability in detergents, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Baccillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using arginine or threonine, preferably threonine, of the methionine residue located in position 197 of the *B.licheniformis* alpha-amylase, known as TERMAMYL®, or the homologous position variation of a similar parent amylase, such as *B. amyloliquefaciens, B. subtilis*, or *B. stearothennophilus*; (b) stability-enhanced amylases as described by Genencor International in a paper entitled "Oxidatively Resistant alpha-Amylases" presented at the 207th American Chemical Society National Meeting, Mar. 13–17, 1994, by C. Mitchinson. Therein it was noted that bleaches in automatic dishwashing detergents inactivate alpha-amylases but that improved oxidative stability amylases have been made by Genencor from *B. licheniformis NCIB*8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®D. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Cellulases usable herein include both bacterial and fungal types, preferably having a pH optimum between 5 and 9. 5. U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, *Dolabella Auricula Solander*. Suitable cellulases are also disclosed in GB-A-2.075.028; GB-A-2.095.275 and DE-OS-2.247.832. CAREZYME® (Novo) is especially useful. See also WO 9117243 to Novo.

Suitable lipase enzymes for detergent usage include those produced by microorganisms of the Pseudomonas group, such as Pseudomonas stutzeri ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P. " Other suitable commercial lipases include Amano-CES, lipases ex *Chromobacter viscosum*, e.g. *Chromobacter viscosum* var. lipolyticum NRRLB 3673 from Toyo Jozo Co., Tagata, Japan; *Chromobacter viscosun* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Cutinase enzymes suitable for use herein are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139 McCarty et al., issued Jan. 5, 1971. Enzymes are further disclosed in U.S. Pat. No. 4,101,457 Place et al, issued July 18, 1978, and U.S. Pat. No. 4,507,219 Hughes, issued Mar. 26, 1985. Enzyme materials useful for liquid detergent formulations, and their incorporation into such formulations, are disclosed in U.S. Pat. No. 4,261,868 Hora et al., issued Apr. 14, 1981. Enzymes for use in detergents can be stabilized by various techniques. Enzyme stabilization techniques are disclosed and exemplified in U.S. Pat. No. 3,600,319 Gedge et al., issued August 17, 1971; EP 199,405 and EP 200,586, Oct. 29, 1986, Venegas. Enzyme stabilization systems are also described, for example, in U.S. Pat. No. 3,519,570. A useful Bacillus, sp. AC13 giving proteases, xylanases and cellulases, is described in WO 9401532 A to Novo.

A further preferred enzyme according to the present invention are mannanase enzymes. When present mannanase enzymes comprise from about 0.0001%, preferably from 0.0005%, more preferably from about 0.001% to about 2%, preferably to about 0.1% more preferably to about 0.02% by weight, of said composition.

Preferably, the following three mannans-degrading enzymes : EC 3.2.1.25: β-mannosidase, EC 3.2.1.78: Endo-1,4-β-mannosidase, referred therein after as "mannanase" and EC 3.2.1.100: 1,4-β-mannobiosidase (IUPAC Classification-Enzyme nomenclature, 1992 ISBN 0-12-227165-3 Academic Press) are useful in the compositions of the present invention.

More preferably, the detergent compositions of the present invention comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans.

In particular, Mannanases (EC 3.2.1.78) constitute a group of polysaccharases which degrade mannans and denote enzymes which are capable of cleaving polyose chains containing mannose units, i.e. are capable of cleaving glycosidic bonds in mannans, glucomannans, galactomannans and galactogluco-mannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

The degradation of galactomannans and galactoglucomannans is facilitated by full or partial removal of the galactose sidebranches. Further the degradation of the acetylated mannans, glucomannans, galactomannans and galactogluco-mannans is facilitated by full or partial deacetylation. Acetyl groups can be removed by alkali or by mannan acetylesterases. The oligomers which are released from the mannanases or by a combination of mannanases and α-galactosidase and/or mannan acetyl esterases can be further degraded to release free maltose by β-mannosidase and/or β-glucosidase.

Mannanases have been identified in several Bacillus organisms. For example, Talbot et al., *Appl. Environ. Microbiol.*, Vol. 56, No. 11, pp. 3505–3510 (1990) describes a beta-mannanase derived from *Bacillus stearothermophilus* in dimer form having molecular weight of 162 kDa and an optimum pH of 5.5–7.5. Mendoza et al., World J. Microbiol. Biotech., Vol. 10, No. 5, pp. 551–555 (1994) describes a beta-mannanase derived from *Bacillus subtilis* having a molecular weight of 38 kDa, an optimum activity at pH 5.0 and 55C and a p1 of 4. 8. JP-03047076 discloses a beta-mannanase derived from Bacillus sp., having a molecular weight of 373 kDa measured by gel filtration, an optimum pH of 8–10 and a pI of 5.3–5.4. JP-63056289 describes the production of an alkaline, thermostable beta-mannanase which hydrolyses beta-1,4-D-mannopyranoside bonds of e.g. mannans and produces manno-oligosaccharides. JP-63036774 relates to the Bacillus microorganism FERM P-8856 which produces beta-mannanase and beta-mannosidase at an alkaline pH. JP-08051975 discloses alkaline beta-mannanases from alkalophilic Bacillus sp. AM-001. A purified mannanase from *Bacillus amyloliquefaciens* useful in the bleaching of pulp and paper and a method of preparation thereof is disclosed in WO 97/11164. WO 91/18974 describes a hemicellulase such as a glucanase, xylanase or mannanase active at an extreme pH and temperature. WO 94/25576 discloses an enzyme from *Aspergillus aculeatus*, CBS 101.43, exhibiting mannanase activity which may be useful for degradation or modification of plant or algae cell wall material. WO 93/24622 discloses a mannanase isolated from *Trichoderma reseei*useful for bleaching lignocellulosic pulps. An hemicellulase capable of degrading mannan-containing hemicellulose is described in WO 91/18974 and a purified mannanase from *Bacillus amyloliquefaciens* is described in WO97/11164.

Preferably, the mannanase enzyme will be an alkaline mannanase as defined below, more preferably, a mannanase originating from a bacterial source. Especially, the laundry detergent composition of the present invention will comprise an alkaline mannanase selected from the mannanase from the strain *Bacillus agaradherens* NICMB 40482 is described in the co-pending U.S. patent application Ser. No. 09/111,256, now abandoned; the mannanase from Bacillus strain 168, gene yght; the mannanase from Bacillus sp. I633 as described in the co-pending application No. PA 1998-01340 and/or the mannanase from Bacillus sp. AAI12. Most preferred mannanase for the inclusion in the detergent compositions of the present invention is the mannanase enzyme originating from Bacillus sp. I633.

The terms "alkaline mannanase enzyme" is meant to encompass an enzyme having an enzymatic activity of at least 10%, preferably at least 25%, more preferably at least 40% of its maximum activity at a given pH ranging from 7 to 12, preferably 7.5 to 10.5.

The alkaline mannanase from *Bacillus agaradherens NICMB* 40482. More specifically, this mannanase is:

i) a polypeptide produced by *Bacillus agaradherens*, NCIMB 40482; or ii) a polypeptide comprising an amino acid sequence as shown in positions 32–343 of SEQ ID NO:2 as shown in U.S. patent application Ser. No. 09/111,256, now abandoned; or iii) an analogue of the polypeptide defined in i) or ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed is the corresponding isolated polypeptide having mannanase activity selected from the group consisting of:

a) polynucleotide molecules encoding a polypeptide having mannanase activity and comprising a sequence of nucleotides as shown in SEQ ID NO: 1 from nucleotide 97 to nucleotide 1029 as shown in U.S. patent application Ser. No. 09/111,256, now abandoned;

b) species homologs of (a);

c) polynucleotide molecules that encode a polypeptide having mannanase activity that is at least 70% identical to the amino acid sequence of SEQ ID) NO: 2 from amino acid residue 32 to amino acid residue 343 as shown in U.S. patent application Ser. No. 09/111,256, now abandoned;

d) molecules complementary to (a), (b) or (c); and e) degenerate nucleotide sequences of (a), (b), (c) or (d).

The plasmid pSJ1678 comprising the polynucleotide molecule (the DNA sequence) encoding said mannanase has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 18, 1998 under the deposition number DSM 12180.

A second more preferred enzyme is the mannanase from the *Bacillus subtilis* strain 169; which is described in WO 99/64573. More specifically, this mannanase is:

i) is encoded by the coding part of the DNA sequence shown in SED ID No. 5shown in WO 99/64573 or an analogue of said sequence; and/or ii) a polypeptide comprising an amino acid sequence as shown SEQ ID NO:6 shown in WO 99/64573; or iii) an analogue of the polypeptide defined in ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed in the corresponding isolated polypeptide having mannanase activity selected from the group consisting of:

a) polynucleotide necules encoding a polypeptide having mannanase activity and comprising a sequence of nucleotides as shown in SEQ ID NO:5 as shown in WO 99/64573;

b) species homologs of (a);

c) polynucleotide molecules that encode a polypeptide having mannanase activity that is at least 70% identical to the amino acid sequence of SEQ ID NO: 6 as shown in WO 99/64573;

d) molecules complementary to (a), (b) or (c); and e) degenerate nucleotide sequences of (a), (b), (c) or (d).

A third more preferred mannanase is described in the co-pending Danish patent application No. PA 1998 01340. More specifically, this mannanase is:

i) a polypeptide produced by Bacillus sp. I633;

ii) a polypeptide comprising in amino acid sequence as shown in positions 33–340 of SEQ ID NO:2 as shown in the Danish application No. PA 1998-01340: or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of:

a) polynucleotide molecules encoding a polypeptide having mannanase activity and comprising a sequence of nucleotides as shown in SEQ ID NO: 1 from nucleotide 317 to nucleotide 1243 the Danish application No. PA 1998-01340;

b) species homologs of (a);

c) polynucleotide molecules that encode a polypeptide having mannanase activity that is at least 65% identical to the amino acid sequence of SEQ D) NO; 2 from amino acid residue 33 to amino acid residue 340 the Danish application No. PA 1998-01340;

d) molecules complementary to (a), (b) or (c); and e) degenerate nucleotide sequences of (a), (b), (c) or (d).

The plasmid pBXM3 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 29, 1998 under the deposition number DSM 12197.

A fourth more preferred mannanase described in the Danish co-pending patent application No. PA 1998-01341. More specifically, this mannase is:

i) a polypeptide produced by Bacillus sp. AAI 12;

ii) a polypeptide comprising an amino acid sequence as shown in positions 25–362 of SEQ ID NO:2; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of a) polynucleotide molecules encoding a polypeptide having mannanase activity and comprising a sequence to nucleotides as shown in SEQ ID NO: 1 from nucleotide 225 to nucleotide 1236 as shown in Danish application No. PA 1998-01341;

b) species homologs of (a);

c) polynucleotide molecules that encode a polypeptide having mannanase activity that is at least 65% identical to the amino acid sequence of SEQ ED NO: 2 from amino acid residue 25 to amino acid residue 362 as shown in the Danish application No. PA 1998-01341;

d) molecules complementary to (a), (b) or (c); and e) degenerate nucleotide sequences of (a), (b), (c) or (d).

The plasmid PBXM1 comprising the polynucleotide molecule (the DNA sequence) a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on Oct. 7, 1998 under the deposition number DSM 12433.

The compositions of the present invention may also comprise a xyloglucanase enzyme. Suitable xyloglucanases for the purpose of the present invention are enzymes exhibiting endoglucanase activity specific for xyloglucan. The xyloglucanase is incorporated into the compositions of the invention preferably at a level of from 0.0001%, more preferably from 0.0005%, most preferably from 0.001% to 2%, preferably to 0.1%, more preferably to 0.02% by weight, of pure enzyme.

As used herein, the term "endoglucanase activity" means the capability of the enzyme to hydrolyze 1,4-β-D-glycosidic linkages present in any cellulosic material, such as cellulose, cellulose derivatives, lichenin, β-D-glucan, or xyloglucan. The endoglucanase activity may be determined in accordance with methods known in the art, examples of which are described in WO 94/14953 and hereinafter. One unit of endoglucanase activity (e.g. CMCU, AVIU, XGU or BGU) is defined as the production of 1 μmol reducing sugar/min from a glucan substrate, the glucan substrate being, e.g., CMC (CMCU), acid swollen Avicell (AVIU), xyloglucan (XGU) or cereal β-glucan (BGU). The reducing sugars are determined as described in WO 94/14953 and hereinafter. The specific activity of an endoglucanase towards a substrate is defined as units/mg of protein.

More specifically, as used herein the term "specific for xyloglucan" means that the endoglucanase enzyme exhibits its highest endoglucanase activity on a xyloglucan substrate, and preferably less than 75% activity, more preferably less than 50% activity, most preferably less than about 25% activity, on other cellulose-containing substrates such as carboxymethyl cellulose, cellulose, or other glucans.

Preferably, the specificity of an endoglucanase towards xyloglucan is further defined as a relative activity determined as the release of reducing sugars at optimal conditions obtained by incubation of the enzyme with xyloglucan and the other substrate to be tested, respectively. For instance, the specificity may be defined as the xyloglucan to β-glucan activity (XGU/BGU), xyloglucan to carboxy methyl cellulose activity (XGU/CMCU), or xyloglucan to acid swollen Avicell activity (XGU/AVIU), which is preferably greater than about 50, such as 75, 90 or 100.

The term "derived from" as used herein refers not only to an endoglucanase produced by strain CBS 101.43, but also an endoglucanase encoded by a DNA sequence isolated from strain CBS 101.43 and produced in a host organism transformed with said DNA sequence. The term "homologue" as used herein indicates a polypeptide encoded by DNA which hybridizes to the same probe as the DNA coding for an endoglucanase enzyme specific for xyloglucan under certain specified conditions (such as presoaking in 5×SSC and pre-hybridizing for 1 h at −40° C. in a solution of 5×SSC, 5×Denhardt's solution, and 50 μg of denatured sonicated calf thymus DNA, followed by hybridization in the same solution supplemented with 50 μCi 32-P-dCTP labeled probe for 18 h at −40° C. and washing three times in 2×SSC, 0.2% SDS at 40° C. for 30 minutes). More specifically, the term is intended to refer to a DNA sequence which is at least 70% homologous to any of the sequences shown above encoding an endoglucanase specific for xyloglucan, including at least 75%, at least 80%, at least 85%, at least 90% or even at least 95% with any of the sequences shown above. The term is intended to include modifications of any of the DNA sequences shown above, such as nucleotide substitutions which do not give rise to another amino acid sequence of the polypeptide encoded by the sequence, but which correspond to the codon usage of the host organism into which a DNA construct comprising any of the DNA sequences is introduced or nucleotide substitutions which do give rise to a different amino acid sequence and therefore, possibly, a different amino acid sequence and therefore, possibly, a different protein structure which might give rise to an endoglucanase mutant with different properties than the native enzyme. Other examples of possible modifications are insertion of one or more nucleotides into the sequence, addition of one or more nucleotides at either end of the sequence, or deletion of one or more nucleotides at either end or within the sequence.

Endoglucanase specific for xyloglucan useful in the present invention preferably is one which has a XGU/BGU, XGU/CMU and/or XGU/AVIU ratio (as defined above) of more than 50, such as 75, 90 or 100.

Furthermore, the endoglucanase specific for xyloglucan is preferably substantially devoid of activity towards β-glucan and/or exhibits at the most 25% such as at the most 10% or about 5%, activity towards carboxymethyl cellulose and/or Avicell when the activity towards xyloglucan is 100%. In addition, endoglucanase specific for xyloglucan of the invention is preferably substantially devoid of transferase activity, an activity which has been observed for most endoglucanases specific for xyloglucan of plant origin.

Endoglucanase specific for xyloglucan may be obtained from the fungal species *A. aculeatus*, as described in WO 94/14953. Microbial endoglucanases specific for xyloglucan has also been described in WO 94/14953. Endoglucanases specific for xyloglucan from plants have been described, but these enzymes have transferase activity and therefore must be considered inferior to microbial endoglucanases specific for xyloglucan whenever extensive degradation of xyloglucan is desirable. An additional advantage of a microbial enzyme is that it, in general, may be produced in higher amounts in a microbial host, than enzymes of other origins.

Enzyme Stabilizing System

Enzyme-containing, including but not limited to, liquid compositions, herein may comprise from about 0.001%, preferably from about 0.005%, more preferably from about 0.0 1% to about 10%, preferably to about 8%, more preferably to about 6% by weight, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical detergent compositions, especially liquids, will comprise from about 1 to about 30, preferably from about 2 to about 20, more preferably from about 8 to about 12 millimoles of calcium ion per liter of finished detergent composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of Calcium and/or Magnesium may of course be useful, for example for promoting the grease-cutting action of certain types of surfactant.

Another stabilizing approach is by use of borate species disclosed in U.S. Pat. No. 4,537,706 Severson, issued Aug. 27, 1985. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Stabilizing systems of certain cleaning compositions may further comprise from 0, preferably from about 0.01% to about 10%, preferably to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during fabric-washing, can be relatively large; accordingly, enzyme stability to chlorine in-use is sometimes problematic. Since perborate or percarbonate, which have the ability to react with chlorine bleach, may present in certain of the instant compositions in amounts accounted for separately from the stabilizing system, the use of additional stabilizers against chlorine, may, most generally, not be essential, though improved results may be obtainable from their use. Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetwaacetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodiun perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired. In general, since the chlorine scavenger function can be performed by ingredients separately listed under better recognized functions, (e.g., hydrogen peroxide sources), there is no absolute requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is majorly incompatible, as formulated, with other reactive ingredients, if used. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392 Baginsli et al., issued Mar. 24, 1987.

FORMULATIONS

As described herein above the compositions of the present invention may be in any liquid form inter alia pourable liquid, paste. Depending upon the specific form of the laundry composition, as well as, the expected use thereof, the formulator may will use different zwitterionic polyamine/branched surfactant combinations.

Preferably the Heavy Duty Liquid (HDL) compositions according to the present invention comprise:

a) from about 0.01%, preferably from about 0.1%, more preferably from 1%, most preferably from 3% to about 20%, preferably to about 10%, more preferably to about 5% by weight, of a zwitterionic polyamine wherein said polyamine comprises more anionic substituents than the number of backbone quaternary nitrogen units; and b) from about 0.01% by weight, preferably from about 0.1% more preferably from about 1% to about 60%, preferably to about 30% by weight, of said composition, of a surfactant system, said surfactant system comprising:

i) from 0.01%, preferably from about 0.1% more preferably from about 1% to about 100%, preferably to about 80% by weight, preferably to about 60%, most preferably to about 30% by weight, of a surfactant selected from the group consisting of mid-chain branched alkyl sulfate surfactants, mid-chain branched alkoxy sulfate surfactants, mid-chain branched aryl sulfonate surfactants, and mixtures thereof;

ii) optionally, but preferably, from 0.01%, preferably from about 0.1% more preferably from about 1% to about 100%, preferably to about 80% by weight, preferably to about 60%, most preferably to about 30% by weight, of one or more nonionic surfactants.

HDL laundry detergent compositions will typically comprise more of anionic detersive surfactants in addition to the preferred use of nonionic surfactants to augment the mid-chain branched surfactants. Therefore, the formulator will generally employ a zwitterionic polyamine having a greater number of cationic charged backbone quaternary units than the number of $R^1$ unit anionic moieties. This net charge balance, taken together with the preferably greater degree of hydrophobicity of backbone R units, inter alia, hexamethylene units, boosts the interaction of the surfactant molecules with the hydrophilic soil active zwitterionic polymers and thereby provides increased effectiveness. The lower net anionic charge of HDL's is surprisingly compatible with the relatively hydrophobic backbones of the more preferred zwitterionic polymers described herein. However, depending upon the composition of the surfactant system, the formnuator may desire to either boost or reduce the hydrophilic character of the R units by the use of, inter alia, alkyleneoxy units in combination with alkylene units.

Preferably the Heavy Duty Liquid (HDL) compositions according to the present invention comprise:

a) from about 0.01%, preferably from about 0.1%, more preferably from 1%, most preferably from 3% to about 20%, preferably to about 10%, more preferably to about 5% by weight, of a zwitterionic polyamine wherein said polyamine comprises less than or equal number of anionic substituents than the number of backbone quaternary nitrogen units; and b) from about 0.01% by weight, preferably from about 0.1% more preferably from about 1% to about 60%, preferably to about 30% by weight, of said composition, of a surfactant system, said surfactant system comprising:

i) from 0.01%, preferably from about 0.1% more preferably from about 1% to about 100%, preferably to about 80% by weight, preferably to about 60%, most preferably to about 30% by weight, of a surfactant selected from the group consisting of mid-chain branched alkyl sulfate surfactants, mid-chain branched alkoxy sulfate surfactants, mid-chain branched aryl sulfonate surfactants, and mixtures thereof;

ii) preferably, from 0.01%, preferably from about 0.1% more preferably from about 1% to about 100%, preferably to about 80% by weight, preferably to about 60%, most preferably to about 30% by weight, of one or more nonionic surfactants, said nonionic surfactants selected form the group consisting of alcohols, alcohol ethoxylates, polyoxyalkylene alkylamides, and mixtures thereof;

iii) optionally, from 0.01%, preferably from about 0.1% more preferably from about 1% to about 100%, preferably to about 80% by weight, preferably to about 60%, most preferably to about 30% by weight, of one or more anionic surfactants.

Another example of a preferred embodiment comprises:

a) from about 0.01%, preferably from about 0.1%, more preferably from 1%, most preferably from 3% to about 20%, preferably to about 10%, more preferably to about 5% by weight, of a zwitterionic polyamine wherein said polyamine comprises less than or equal number of anionic substituents than the number of backbone quaternary nitrogen units;

b) from about 0.01% by weight, preferably from about 0.1% more preferably from about 1% to about 60%, preferably to about 30% by weight, of said composition, of a surfactant system, said surfactant system comprising:

i) from 0.01%, preferably from about 0.1% more preferably from about 1% to about 100%, preferably to about 80% by weight, preferably to about 60%, most preferably to about 30% by weight, of a surfactant selected from the group consisting of mid-chain branched alkyl sulfate surfactants, mid-chain branched alkoxy sulfate surfactants, mid-chain branched aryl sulfonate surfactants, and mixtures thereof;

ii) preferably, from 0.01%, preferably from about 0.1% more preferably from about 1% to about 100%, preferably to about 80% by weight, preferably to about 60%, most preferably to about 30% by weight, of one or more nonionic surfactants, said nonionic surfactants selected form the group consisting of alcohols, alcohol ethoxylates, polyoxyalkylene alkylamides, and mixtures thereof;

iii) optionally, from 0.01%, preferably from about 0.1% more preferably from about 1% to about 100%, preferably to about 80% by weight, preferably to about 60%, most preferably to about 30% by weight, of one or more anionic surfactants; and c) from 0.001% (10 ppm) by weight, of an enzyme, preferably said enzyme is selected from the group consisting of proteases, cellulases, lipases, amylases, peroxidases, mannanases, xyloglucanases, and mixtures thereof.

As an adjunct to the enzyme system, in a preferred embodiment of the present invention, the formulator may also include from about 1 ppb (0.0000001%) by weight of the composition, of a transition-metal fabric cleaning catalyst.

ADJUNCT INGREDIENTS

The following are non-limiting examples of adjunct ingredients useful in the laundry compositions of the present invention, said adjunct ingredients include builders, optical brighteners, soil release polymers, dye transfer agents, dispersents, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

Builders—The laundry detergent compositions of the present invention preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder.

The level of builder can vary widely depending upon the end use of the composition and its desired physical form. When present, the compositions will typically comprise at least about 1% builder. Formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839 Rieck, issued May 12, 1987. NaSKS-6 is the trademark for a crystalline layered silicate marketed by Hoechst (commonly abbreviated herein as "SKS-6"). Unlike zeolite builders, the Na SKS6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$[M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occuring aluminosilicates or synthetically derived. A method for producing aluminosilicate ion exchange materials is disclosed in U.S. Pat. No. 3,985,669, Krummel et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "poly-carboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxy lates, including oxydisuccinate, as disclosed in U.S. Pat. No. 3,128,287 Berg, issued Apr. 7, 1964, and U.S. Pat. No. 3,635,830 Lamberti et al., issued Jan. 18, 1972. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923,679 Rapko, issued Dec. 2, 1975; U.S. Pat. No. 4,158,635 Crutchfield et al., issued Jun. 19, 1979; U.S. Pat. No. 4,120,874 Crutchfield et al., issued Oct. 17, 1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is do-decenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al., issued Mar. 13, 1979 and in U.S. Pat. No. 3,308,067, Diehl, issued March 7, 1967. See also Diehl U.S. Pat. No. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and U.S. Pat. No. 3,422,137) can also be used.

Dispersants

A description of other suitable polyalkyleneimine dispersants which may be optionally combined with the bleach stable dispersants of the present invention can be found in U.S. Pat. No. 4,597,898 Vander Meer, issued Jul. 1, 1986; European Patent Application 111,965 Oh and Gosselink, published Jun. 27, 1984; European Patent Application 111,984 Gosselink, published Jun. 27, 1984; European Patent Application 112,592 Gosselink, published Jul. 4, 1984; U.S. Pat. No. 4,548,744 Connor, issued Oct. 22, 1985; and U.S. Pat. No. 5,565,145 Watson et al., issued Oct. 15, 1996; all of which are included herein by reference. However, any suitable clay/soil dispersant or anti-redepostion agent can be used in the laundry compositions of the present invention.

In addition, polymeric dispersing agents which include polymeric polycarboxylates and polyethylene glycols, are suitable for use in the present invention. Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in U.S. Pat. No. 3,308,067 Diehl, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000, preferably from about 5,000, more preferably from about 7,000 to 100,000, more preferably to 75,000, most preferably to 65,000. The ratio of acrylate to maleate segments in such copolymers will generally range from about 30:1 to about 1:1, more preferably from about I 0:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg. ) of about 10,000.

Soil Release Agents

The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occuring subsequent to treatment with the soil release agent to be more easily cleaned in later washing procedures.

The following, all included herein by reference, describe soil release polymers suitable for use in the present invention. U.S. Pat. No. 5,843,878 Gosselink et al., issued Dec. 1, 199; U.S. Pat. No. 5,834,412 Rohrbaugh et al., issued Nov. 10, 1998; U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink issued Aug. 29, 1989; U.S. Pat. No. 4,877,896 Maldonado et al., issued Oct. 31, 1989; U.S. Pat. No. 4,771,730 Gosselink et aL, issued Oct. 27, 1987; U.S. Pat. No. 711,730 Gosselink et al., issued Dec. 8, 1987; U.S. Pat. No. 4,721,580 Gosselink issued Jan.26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al. ; U.S. Pat. No. 4,240,918 Lagasse et al; U.S. Pat. No. 4,525,524 Tung et al. ; U.S. Pat. No. 4,579,681 Ruppert et al. ; U.S. Pat. No. 4,220,918; U.S. Pat. No. 4,787,989; EP 279,134 A, 1988 to Rhone-Poulenc Chernie; EP 457,205 A to BASF (1991); and DE 2,335,044 to Unilever N.V., 1974; all incorporated herein by reference.

METHOD OF USE

The present invention further relates to a method for removing hydrophilic soils form fabric, preferably clothing, said method comprising the step of contacting fabric in need of cleaning with an aqueous solution of a laundry detergent composition comprising:

a) from about 0.01% by weight of a zwitterionic polyamine according to the present invention;

b) from about 0.01% by weight, of a surfactant system comprising:
   i) from 0% to 80% by weight, of a mid-chain branched alkyl sulfate surfactant;
   ii) from 0% to 80% by weight, of a mid-chain branched aryl sulfonate surfactant;
   iii) optionally from 0.01% by weight, of a surfactant selected from the group consisting of anionic, nonionic, cationic, zwitterionic, ampholytic surfactants, and mixtures thereof;

c) from about 1%, preferably from about 5% to about 80%, preferably to about 50% by weight, of a peroxygen bleaching system comprising:
   i) from about 40%, preferably from about 50%, more preferably from about 60% to about 100%, preferably to about 95%, more preferably to about 80% by weight, of the bleaching system, a source of hydrogen peroxide;
   ii) optionally from about 0.1%, preferably from about 0.5% to about 60%, preferably to about 40% by weight, of the beaching system, a beach activator;
   iii) optionally from about I ppb (0.0000001%), more preferably from about 100 ppb (0.00001%), yet more preferably from about 500 ppb (0.00005%), still more preferably from about 1 ppm (0.0001%) to about 99.9%, more preferably to about 50%, yet more preferably to about 5%, still more preferably to about 500 ppm (0.05%) by weight of the composition, of a transition-metal bleach catalyst;
   iv) optionally from about 0.1% by weight, of a preformed peroxygen bleaching agent; and d) the balance carriers and other adjunct ingredients.

Preferably the aqueous solution comprises at least about 0.01%, preferably at least about 1% by weight, of said laundry detergent composition.

The compositions of the present invention can be suitably prepared by any process chosen by the formulator, non-limiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

The following are non-limiting examples of compositions according to the present invention.

TABLE I

| | weight % | | |
|---|---|---|---|
| Ingredients | 5 | 6 | 7 |
| Branched alkyl sulfate[1] | 10.0 | 10.0 | 10.0 |
| Branched aryl sulphonate[2] | — | 10.0 | — |
| Sodium $C_{12}$–$C_{15}$ alcohol sulfate | 10.0 | — | — |
| Sodium linear alkylbenzene sulphonate | — | — | 10.0 |
| Sodium $C_{12}$–$C_{15}$ alcohol ethoxy (1.8) sulfate | 1.0 | — | — |
| Cationic surfactant[3] | 0.5 | 0.5 | — |
| Nonionic surfactant[4] | 0.63 | 0.63 | — |
| Polyamine[5] | 2.0 | 2.0 | 2.5 |
| Sodium carbonate | 25.0 | 17.0 | 25.0 |
| Builder[6] | 25.0 | 20.0 | 20.0 |
| Protease enzyme[7] | 0.70 | 0.70 | 0.70 |
| Protease enzyme[8] | 0.70 | — | 0.70 |
| Dispersant[9] | 1.0 | 1.0 | 2.0 |
| Soil release polymer[10] | 0.50 | 0.50 | 0.50 |

TABLE I-continued

| Ingredients | weight % 5 | 6 | 7 |
|---|---|---|---|
| Bleaching system[11] | 8.0 | — | 6.0 |
| Minors[12] | balance | balance | balance |

[1]$C_{10}$–$C_{13}$ mid-chain branched alkyl sulfate admixture.
[2]Mid-chain branched aryl sulphonate admixture according to Example 4.
[3]Coconut trimethylammonium chloride.
[4]NEODOL 23-9 ex Shell Oil Co.
[5]4,9-dioxa-1,12-dodecanediamine, ethoxylated to average E20 per NH, quaternized to 90%, and sulfated to 90%.
[6]Zeolite A, hydrate (0.1–10 micron size).
[7]Bleach stable variant of BPN' (Protease A-BSV) as disclosed in EP 130, 756 A Jan. 9, 1985.
[8]Protease variants at position 103 of *Bacillus amyloliquefaciens* as described in WO 99/20727.
[9]Polyacrylate/maleate co-polymer.
[10]Soil release polymer according to U.S. Pat. No. 5,415,807 Gosselink et al., issued May 16, 1995.
[11]Bleaching system comprising NOBS (5%) and perborate (95%).
[12]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE II

| Ingredients | weight % 8 | 9 | 10 |
|---|---|---|---|
| Branched alkyl sulfate[1] | 20.0 | — | — |
| Branched aryl sulphonate[2] | — | 10.0 | 20.0 |
| Sodium $C_{12}$–$C_{15}$ alcohol sulfate | — | 10.0 | — |
| Sodium $C_{12}$–$C_{15}$ alcohol ethoxy (1.8) sulfate | 1.0 | — | — |
| Cationic surfactant[3] | — | 0.50 | 0.50 |
| Polyamine[4] | 1.0 | 2.5 | 2.0 |
| Sodium carbonate | 30.0 | 20.0 | 25.0 |
| Builder[5] | 20.0 | 25.0 | 21.0 |
| Protease enzyme[6] | 0.70 | 0.70 | — |
| Protease enzyme[7] | 0.70 | 0.70 | 0.70 |
| Protease enzyme[8] | 1.0 | 1.0 | — |
| Dispersant[9] | 1.0 | — | 1.0 |
| Soil release polymer[10] | — | 0.50 | 0.50 |
| Bleaching system[11] | — | 5.5 | 6.2 |
| Minors[12] | balance | balance | balance |

[1]$C_{10}$–$C_{13}$ mid-chain branched alkyl sulfate admixture.
[2]Mid-chain branched aryl sulphonate admixture according to Example 4.
[3]Coconut trimethylammonium chloride.
[4]4,9-dioxa-1,12-dodecanediamine, ethoxylated to average E20 per NH, quaternized to 90%, and sulfated to 90%.
[5]Zeolite A, hydrate (0.1–10 micron size).
[6]Bleach stable variant of BPN' (Protease A-BSV) as disclosed in EP 130, 756 A Jan. 9, 1985.
[7]Protease variants at position 103 of *Bacillus amyloliquefaciens* as described in WO 99/20727.
[8]ALCALASE ® ex Novo.
[9]Polyacrylate/maleate co-polymer.
[10]Soil release polymer according to U.S. Pat. No. 5,415,807 Gosselink et al., issued May 16, 1995.
[11]Bleaching system comprising NOBS (5%) and perborate (95%).
[12]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE III

| Ingredients | weight % 11 | 12 | 13 |
|---|---|---|---|
| Branched alkyl sulfate[1] | 10.0 | 10.0 | 10.0 |
| Branched aryl sulphonate[2] | — | — | 10.9 |
| Sodium $C_{12}$–$C_{15}$ alcohol sulfate | 10.0 | 10.0 | — |

TABLE III-continued

| Ingredients | weight % 11 | 12 | 13 |
|---|---|---|---|
| Sodium linear alkylbenzene sulphonate | — | — | — |
| Sodium $C_{12}$–$C_{15}$ alcohol ethoxy (1.8) sulfate | 1.0 | — | — |
| Sodium $C_{12}$–$C_{15}$ alcohol ethoxy (2.25) sulfate | — | 1.0 | — |
| Cationic surfactant[3] | 0.5 | 0.5 | 0.50 |
| Nonionic surfactant[4] | 0.63 | — | 0.63 |
| Polyamine[5] | 2.2 | 1.8 | 1.0 |
| Sodium carbonate | 30.0 | 20.0 | 17.0 |
| Builder[6] | 25.0 | 35.0 | 30.0 |
| Protease enzyme[7] | 0.70 | 0.70 | 0.70 |
| Protease enzyme[8] | 0.70 | 0.70 | — |
| Protease enzyme[9] | — | 1.0 | 0.90 |
| Dispersant[10] | 1.0 | — | 1.0 |
| Soil release polymer[11] | 0.50 | 0.50 | 1.0 |
| Bleaching system[12] | 0.05 | 0.05 | 0.05 |
| Minors[13] | balance | balance | balance |

[1]$C_{10}$–$C_{13}$ mid-chain branched alkyl sulfate admixture.
[2]Mid-chain branched aryl sulphonate admixture according to Example 4.
[3]Coconut trimethylammonium chloride.
[4]NEODOL 23-9 ex Shell Oil Co.
[5]4,9-dioxa-1,12-dodecanediamine, ethoxylated to average E20 per NH, quaternized to 90%, and sulfated to 90%.
[6]Zeolite A, hydrate (0.1–10 micron size).
[7]Bleach stable variant of BPN' (Protease A-BSV) as disclosed in EP 130, 756 A Jan. 9, 1985.
[8]Protease variants at position 103 of *Bacillus amyloliquefaciens* as described in WO 99/20727.
[9]ALCALASE ® ex Novo.
[10]Polyacrylate/maleate co-polymer.
[11]Soil release polymer according to U.S. Pat. No. 5,415,807 Gosselink et al., issued May 16, 1995.
[12]5,12-dimethyl-1,5,8,12-tetraaza-bicyclo[6.6.2]hexadecane manganese (II) chloride.
[13]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE IV

| Ingredients | weight % 14 | 15 | 16 |
|---|---|---|---|
| Branched alkyl sulfate[1] | 10.0 | — | 20.0 |
| Branched aryl sulphonate[2] | — | 20.0 | — |
| Sodium linear alkylbenzene sulphonate | 10.0 | — | — |
| Sodium $C_{12}$–$C_{15}$ alcohol ethoxy (1.8) sulfate | — | — | 1.0 |
| Sodium $C_{12}$–$C_{15}$ alcohol ethoxy (2.25) sulfate | 1.0 | — | — |
| Cationic surfactant[3] | — | 0.50 | — |
| Nonionic surfactant[4] | — | 0.7 | — |
| Polyamine[5] | 3.0 | 2.5 | 2.0 |
| Sodium carbonate | 25.0 | 25.0 | 30.0 |
| Builder[6] | 30.0 | 35.0 | 20.0 |
| Protease enzyme[7] | 0.80 | — | 0.80 |
| Protease enzyme[8] | 0.70 | 0.60 | 0.70 |
| Protease enzyme[9] | — | 1.0 | 1.0 |
| Dispersant[10] | 2.0 | 1.5 | 1.0 |
| Soil release polymer[11] | 0.50 | 0.50 | — |
| Bleaching system[12] | — | 0.02 | — |
| Minors[13] | balance | balance | balance |

[1]$C_{10}$–$C_{13}$ mid-chain branched alkyl sulfate admixture.
[2]Mid-chain branched aryl sulphonate admixture according to Example 4.
[3]Coconut trimethylammonium chloride.
[4]NEODOL 23-9 ex Shell Oil Co.
[5]4,7,10-trioxa-1,13-tridecanediamine, ethoxylated to Average E20 per NH, quaternized to 90%, and sulfated to 90%.
[6]Zeolite A, hydrate (0.1–10 micron size).
[7]Bleach stable variant of BPN' (Protease A-BSV) as disclosed in EP 130, 756 A Jan. 9, 1985.
[8]Protease variants at position 103 of *Bacillus amyloliquefaciens* as described in WO 99/20727.

TABLE IV-continued

| Ingredients | weight % | | |
|---|---|---|---|
| | 14 | 15 | 16 |

[9]ALCALASE ® ex Novo.
[10]Polyacrylate/maleate co-polymer.
[11]Soil release polymer according to U.S. Pat. No. 5,415,807 Gosselink et al., issued May 16, 1995.
[12]5,12-dimethyl-1,5,8,12-tetraaza-bicyclo[6.6.2]hexadecane manganese (II) chloride.
[13]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE V

| Ingredients | weight % | | | |
|---|---|---|---|---|
| | 17 | 18 | 19 | 20 |
| Polyhydroxy Coco-Fatty Acid Amide | 2.50 | 2.50 | — | — |
| Branched AE surfactant[1] | — | — | 3.65 | 0.80 |
| Branched AS surfactant[2] | — | — | 6.03 | 2.50 |
| Branched AES surfactant[3] | 20.15 | 20.15 | — | — |
| Branched AES surfactant[4] | — | — | 18.00 | 18.00 |
| Alkyl N-Methyl Glucose Amide | — | — | 4.50 | 4.50 |
| $C_{10}$ Amidopropyl Amine | 0.50 | 0.50 | 1.30 | — |
| Citric Acid | 2.44 | 3.00 | 3.00 | 3.00 |
| Fatty Acid ($C_{12}$–$C_{14}$) | — | — | 2.00 | 2.00 |
| NEODOL 23-9[5] | 0.63 | 0.63 | — | — |
| Polyamine[6] | 2.0 | 1.5 | 2.0 | 1.5 |
| Ethanol | 3.00 | 2.81 | 3.40 | 3.40 |
| Monoethanolamine | 1.50 | 0.75 | 1.00 | 1.00 |
| Propanediol | 8.00 | 7.50 | 7.50 | 7.00 |
| Boric Acid | 3.50 | 3.50 | 3.50 | 3.50 |
| Dispersant[7] | 0.50 | — | — | — |
| Dispersant[8] | 0.50 | 0.50 | 2.00 | 1.00 |
| Tetraethylenepentamine | — | 1.18 | — | — |
| Sodium Toluene Sulfonate | 2.50 | 2.25 | 2.50 | 2.50 |
| NaOH | 2.08 | 2.43 | 2.62 | 2.62 |
| Protease enzyme[9] | 0.78 | 0.70 | — | — |
| Protease enzyme[10] | — | — | 0.88 | — |
| ALCALASE[11] | — | — | — | 1.00 |
| Pro-fragrance[12] | 1.00 | 1.25 | 1.50 | 2.00 |
| Water and minors[13] | balance | balance | balance | balance |

[1]Branched $C_{12}$–$C_{13}$ alcohol ethoxylate $E_9$
[2]Sodium branched $C_{12}$–$C_{15}$ alcohol sulfate.
[3]Sodium branched $C_{12}$–$C_{15}$ alcohol ethoxylate $E_{1.8}$ sulfate.
[4]Sodium branched $C_{14}$–$C_{15}$ alcohol ethoxylate $E_{2.25}$ sulfate.
[5]$E_9$ Ethoxylated Alcohols as sold by the Shell Oil Co.
[6]Bis(hexamethylene)triamine, ethoxylated to average E20 per NH, quaternized to 90%, and sulfated to 40%.
[7]Ethoxylated tetraethylenepentamine (PEI 189 $E_{15}$–$E_{18}$) according to U.S. Pat. No. 4,597,898 Vander Meer issued Jul. 1, 1986.
[8]PEI 1800 $E_7$ according to U.S. Pat. No. 5,565,145 Watson et al., issued Oct. 15, 1996.
[9]Bleach stable variant of BPN' (Protease A-BSV) as disclosed in EP 130, 756 A Jan. 9, 1985.
[10]Subtilisin 309 Loop Region 6 variant.
[11]Proteolytic enzyme as sold by Novo.
[12]3,7-dimethyl-1,6-octadien-3-yl 3-(β-naphthyl)-3-oxo-propionate.
[13]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE VI

| Ingredients | weight % | | | |
|---|---|---|---|---|
| | 21 | 22 | 23 | 24 |
| Polyhydroxy Coco-Fatty Acid Amide | 3.65 | 3.50 | — | — |

TABLE VI-continued

| Ingredients | weight % | | | |
|---|---|---|---|---|
| | 21 | 22 | 23 | 24 |
| Branched AE surfactant[1] | 3.65 | 0.80 | — | — |
| Branched AS surfactant[2] | 6.03 | 2.50 | — | — |
| Branched AES surfactant[3] | 9.29 | 15.10 | — | — |
| Branched AES surfactant[4] | — | — | 18.00 | 18.00 |
| Alkyl N-Methyl Glucose Amide | — | — | 4.50 | 4.50 |
| $C_{10}$ Amidopropyl Amine | — | 1.30 | — | — |
| Citric Acid | 2.44 | 3.00 | 3.00 | 3.00 |
| Fatty Acid ($C_{12}$–$C_{14}$) | 4.23 | 2.00 | 2.00 | 2.00 |
| NEODOL 23-9[5] | — | — | 2.00 | 2.00 |
| Polyamine[6] | 3.5 | 2.0 | 3.5 | 2.0 |
| Ethanol | 3.00 | 2.81 | 3.40 | 3.40 |
| Monoethanolamine | 1.50 | 0.75 | 1.00 | 1.00 |
| Propanediol | 8.00 | 7.50 | 7.50 | 7.00 |
| Boric Acid | 3.50 | 3.50 | 3.50 | 3.50 |
| Tetraethylenepentamine | — | 1.18 | — | — |
| Sodium Toluene Sulfonate | 2.50 | 2.25 | 2.50 | 2.50 |
| NaOH | 2.08 | 2.43 | 2.62 | 2.62 |
| Protease enzyme[7] | 0.78 | 0.70 | — | — |
| Protease enzyme[8] | — | — | 0.88 | — |
| ALCALASE[9] | — | — | — | 1.00 |
| Dispersant[10] | 0.50 | 0.50 | 2.00 | 1.00 |
| Pro-fragrance[11] | 2.00 | 1.50 | 1.50 | 2.50 |
| Water and minors[12] | balance | balance | balance | balance |

[1]Branched $C_{12}$–$C_{13}$ alcohol ethoxylate $E_9$
[2]Sodium branched $C_{12}$–$C_{15}$ alcohol sulfate.
[3]Sodium branched $C_{12}$–$C_{15}$ alcohol ethoxylate $E_{2.5}$ sulfate.
[4]Sodium branched $C_{14}$–$C_{15}$ alcohol ethoxylate $E_{2.25}$ sulfate.
[5]$E_9$ Ethoxylated Alcohols as sold by the Shell Oil Co.
[6]Bis(hexamethylene)triamine, ethoxylated to average E20 per NH, quaternized to 90%, and sulfated to 35%.
[7]Bleach stable variant of BPN' (Protease A-BSV) as disclosed in EP 130, 756A Jan. 9, 1985.
[8]Subtilisin 309 Loop Region 6 variant.
[9]Proteolytic enzyme as sold by Novo.
[10]PEI 1200 $E_7$ according to U.S. Pat. No. 5,565,145 Watson et al., issued Oct. 15, 1996.
[11]3,7-dimethyl-1,6-octadien-3-yl 3-(β-naphthyl)-3-oxo-propionate.
[12]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE VII

| Ingredients | Weight % | | |
|---|---|---|---|
| | 25 | 26 | 27 |
| Branched alkyl sulfate[1] | 1.00 | 1.00 | 1.00 |
| Sodium $C_{12}$ alkyl benzene sulfonate (LAS) | 18.00 | 18.00 | 18.00 |
| $C_{12}$–$C_{14}$ dimethyl hydroxyethyl ammonium chloride | 0.60 | 0.60 | 0.60 |
| Polyamine[2] | 2.00 | 2.50 | 2.00 |
| Sodium tripolyphosphate | 22.50 | 22.50 | 22.50 |
| Maleic/acrylic acid copolymer (1:4) MW = 70,000 | 0.90 | 0.60 | 0.60 |
| Carboxymethylcellulose (CMC) | 0.40 | 0.20 | 0.20 |
| Sodium carbonate | 13.00 | 13.30 | 13.30 |
| Diethylene triamine pentamethylene phosphonate[3] | 0.90 | 0.30 | 0.30 |
| NOBS[4] | 1.90 | 0.65 | 0.65 |
| Sodium perborate | 2.25 | 0.70 | 0.70 |
| Photobleach[5] (ppm) | 45 | 45 | 45 |
| Silicate[6] | 5.30 | — | — |
| Soil Release Polymer[7] | 0.10 | 0.20 | 0.20 |
| Brightener 49 | 0.05 | 0.05 | 0.05 |
| Brightener 15 | 0.15 | 0.15 | 0.15 |
| Savinase Ban (6/100) | 0.45 | 0.45 | 0.45 |
| Carezyme (5T) | 0.07 | 0.07 | 0.07 |
| Perfume | 0.33 | 0.33 | 0.33 |

TABLE VII-continued

| Ingredients | Weight % | | |
|---|---|---|---|
| | 25 | 26 | 27 |
| Perfume[8] | 0.25 | 0.10 | 0.20 |
| Minors and water | balance | balance | balance |

[1]Sodium branched $C_{12}$ alkyl benzene sulfonate (BAS).
[2]4,7,10-trioxa-1,13-tridecanediamine, ethoxylated to average E20 per NH, quaternized to 90%, and sulfated to 90%.
[3]DEQUEST 2060 as marketed by Monsanto.
[4]Sodium nonyloxybenzene sulfonate
[5]Sulfonated zinc phthalocyanine according to U.S. Pat. No. 4,033,718, Holcombe el al., issued Jul. 5, 1977.
[6]$SiO_2/Na_2O$ ratio of 1.6:1.
[7]Soil release polymer according to U.S. Pat. No. 5,415,807, Gosselink et al., issued May 16, 1995.
[8]One or more perfume ingredients including pro-accords.

The following are futher examples of granular laundry detergent compositions according to the present invention.

TABLE VIII

| Ingredients | Weight % | | |
|---|---|---|---|
| | 28 | 29 | 30 |
| Branched alkyl sulfate[1] | 9.00 | 18.00 | 18.00 |
| Sodium $C_{12}$ alkyl benzene sulfonate (LAS) | 9.00 | — | — |
| Sodium $C_{12}$–$C_{15}$ alkyl ethoxylate (E3) sulfate | 1.00 | 1.00 | 1.00 |
| $C_{12}$–$C_{14}$ dimethyl hydroxyethyl ammonium chloride | 0.60 | 0.60 | 0.60 |
| Polyamine[2] | 3.00 | 3.00 | 3.00 |
| Sodium tripolyphosphate | 22.50 | 22.50 | 22.50 |
| Maleic/acrylic acid copolymer (1:4) MW = 70,000 | 0.60 | 0.60 | 0.90 |
| Carboxymethylcellulose (CMC) | 0.40 | 0.20 | 0.20 |
| Sodium carbonate | 13.30 | 13.30 | 13.30 |
| Diethylene triamine pentamethylene phosphonate[3] | 0.30 | 0.30 | 0.30 |
| NOBS[4] | 0.65 | 0.65 | — |
| Sodium perborate | 0.70 | 0.70 | — |
| Photobleach[5] (ppm) | 45 | 45 | 45 |
| Soil Release Polymer[6] | 0.20 | 0.20 | 0.20 |
| Dispersent[7] | — | — | 0.35 |
| Brightener 49 | 0.05 | 0.05 | 0.05 |
| Brightener 15 | 0.15 | 0.15 | 0.15 |
| Savinase Ban (6/100) | 0.45 | 0.45 | 0.45 |
| Lipolase | — | — | 0.08 |
| Carezyme (5T) | 0.07 | 0.07 | 0.07 |
| Perfume | 0.33 | 0.33 | 0.33 |
| Minors and water | balance | balance | balance |

[1]Sodium branched $C_{12}$ alkyl benzene sulfonate (BAS).
[2]4,9-dioxa-1,12-dodecanediamine, ethoxylated to average E20 per NH, quaternized to 90%, and sulfated to 90%.
[3]DEQUEST 2060 as marketed by Monsanto.
[4]Sodium nonyloxybenzene sulfonate.
[5]Sulfonated zinc phthalocyanine according to U.S. Pat. No. 4,033,718, Holcombe et al., issued July 5, 1977.
[6]Soil release polymer according to U.S. Pat. No. 5,415,807, Gosselink et al., issued May 16, 1995.
[8]Ethoxylated polyethylene dispersent according to U.S. Pat. No. 5,565,145, Watson et al., issued Oct. 15, 1996.

What is claimed is:

1. A laundry detergent composition comprising:

a) from about 0.01% to about 20% by weight, of a zwitterionic polyamine having formula:

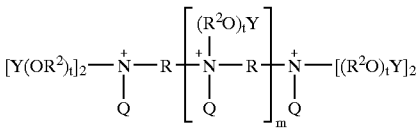

wherein R units have the formula $—(R^2O)_wR^3—$ wherein $R^2$ and $R^3$ are each independently selected from the group consisting of $C_2$–$C_8$ linear alkylene, $C_3$–$C_8$ branched alkylene, phenylene, substituted phenylene, and mixtures thereof; w is from 0 to about 25: Y is an anionic unit selected from the group consisting of $—(CH_2)_fCO_2M$, $—C(O)(CH_2)_fCO_2M$, $—(CH_2)_fPO_3M$, $—(CH_2)_fOPO_3M$, $—(CH_2)_fSO_3M$ $—CH_2(CHSO_3M)(CH_2)_fSO_3M$, $—CH_2(CHSO_2M)(CH_2)_fSO_3M$, and mixtures thereof; M is hydrogen, a water soluble cation, and mixtures thereof the index f is from 0 to about 10; O is a quaternizing unit selected from the group consisting of $C_1$–$C_4$ linear alkyl, $C_1$–$C_4$ hydroxyalkyl, benzyl, $(R^2O)_1Y$, and mixtures thereof; the index m is from 0 to 20; the index t is from about 0.5 to about 100; wherein when m is equal to 0, then w is equal to 0:

b) from about 0.01% to about 80% by weight, of a surfactant system comprising one or more mid-chain branched surfactants selected from the group consisting of mid-chain branched alkyl sulfates, mid-chain branched alkoxy sulfates, mid-chain branched aryl sulphonates, and mixtures thereof;

c) optionally from about 0.01% to about 60% by weight, of one or more non-mid-chain branched surfactants; and d) the balance caters and adjunct ingedients.

2. A composition according to claim 1 Y has the formula $—SO_3M$ wherein M is a water soluble cation.

3. A composition according to claim 1 wherein said zwitterionic polymer comprises an anionic-to-cationic charge ratio $Q_r$ of at least 1.

4. A composition according to claim 3 wherein said zwitterionic polymer comprises an anionic-to-cationic charge ratio $Q_r$ of at least 1.5.

5. A composition according to claim 1 wherein Y is $—SO_3M$.

6. A composition according to claim 1 further comprising from about 1% to about 80% by weight, of a peroxygen bleaching system comprising:

i) from about 40% to about 100% by weight, of the bleaching system, a source of hydrogen peroxide;

ii) optionally from about 0.1% to about 60% by weight, of the beaching system, a beach activator;

iii) optionally from about 1 ppb of the composition to about 50% by weight, of a transition-metal bleach catalyst; and iv) optionally from about 0.1% to about 10% by weight, of a pre-formed peroxygen bleaching agent.

7. A granular laundry detergent composition comprising a) from about 0.01% to about 20% by weight of a zwitterionic polyamine, said polyamine having the formula:

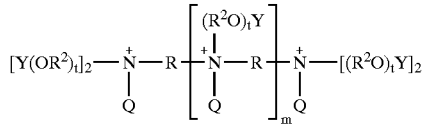

wherein R comprises alkyleneoxyalkylene units having the formula:

$—(R^2O)_w(R^3)—$ and mixtures thereof;

$R^2$ is selected from the group consisting of ethylene, 1,2-propylene, 1,3-propylene, 1,2-butylene, 1,4-butylene, and mixtures thereof;

$R^3$ is $C_2$–$C_8$ linear alkylene, $C_3$–$C_8$ branched alkylene, phenylene, substituted phenylene, and mixtures thereof:

Q is a quaternizing unit selected from the group consisting of $C_1$–$C_4$ linear alkyl, benzyl, and mixtures thereof;

Y is an anionic unit selected from the group consisting of —$(CH_2)_fCO_2M$, —$C(O)(CH_2)_fCO_2M$, —$(CH_2)_fPO_3M$, —$(CH_2)_fOPO_3M$, —$(CH_2)_fSO_3M$, —$CH_2(CHSO_3M)(CH_2)_fSO_3M$, —$CH_2(CHSO_2M)(CH_2)_fSO_3M$, and mixtures thereof;

M is hydrogen, a water soluble cation, and mixtures thereof; the index f is from 0 to about 10;

the index m is from 0 to 20; the index t is from 15 to 100; the index w is from 0 to 25; wherein when m is equal to 0, then w is equal to 0;

b) from about 0.01% to about 80% by weight, of a surfactant system comprising:

i) from 0% to 80% by weight, of a mid-chain branched alkyl sulfate surfactant selected from the group consisting of surfactants having the formula:

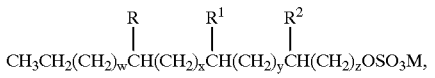

the formula:

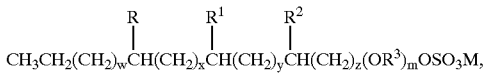

and mixtures thereof; wherein R, $R^1$, and $R^2$ are each independently hydrogen, $C_1$–$C_3$ alkyl, and mixtures thereof, provided the total number of carbon atoms in said surfactant is from 14 to 20 and at least one of R, $R^1$, and $R^2$ is not hydrogen; the index w is an integer from 0 to 13; x is an integer from 0 to 13; y is an integer from 0 to 13; z is an integer of at least 1; provided w+x+y+z is from 8 to 14 and the total number of carbon atoms in a surfactant is from 14 to 20; $R^3$ is ethylene, 1,2-propylene, 1,3-propylene, 1,2-butylene, 1,4-butylene, and mixtures thereof; the average value of the index m is at least about 0.01 to about 3; M is a water soluble cation;

ii) from 0% to 80% by weight, of a mid-chain branched aryl sulfonate surfactant having the formula:

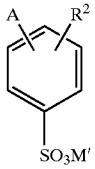

wherein A is a mid-chain branched alkyl unit having the formula:

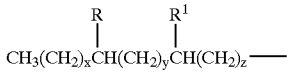

wherein R and $R^2$ are each independently hydrogen, $C_1$–$C_3$ alkyl, and mixtures thereof, provided the total number of carbon atoms in said alkyl unit is from 6 to 18 and at least one of R and $R^1$ is not hydrogen: x is an integer from 0 to 13; y is an integer from 0 to 13; z is 0 or 1; $R^2$ is hydrogen, $C_1$–$C_3$ alkyl, and mixtures thereof: M' is a water soluble cation with sufficient charge to provide neutrality;

iii) optionally from 0.01% to about 90% by weight, of a surfactant selected from the group consisting of anionic, nonionic, cationic, zwitterionic. ampholytic surfactants, and mixtures thereof:

c) from about 1% to about 80% by weight, of a peroxygen bleaching system comprising:

i) from about 40% to about 100% by weight, of the bleaching system, a source of hydrogen peroxide;

ii) optionally from about 0.1% to about 60% by weight, of the beaching system, a beach activator;

iii) optionally from about 1 ppb of the composition to about 50% by weight, of a transition-metal bleach catalyst;

iv) optionally from about 0.1% to about 10% by weight, of a pre-formed peroxygen bleaching agent; and d) the balance carriers and adjunct ingredients.

8. A liquid laundry detergent composition comprising a) from about 0.01% to about 20% by weight of a zwitterionic polyamine, said polyamine having the formula:

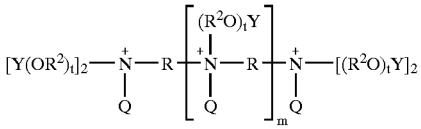

R is a backbone unit comprises poly(alkyleneoxy)alkylene units having the formula:

$$—(R^2O)_w(R^3)—$$

and mixtures thereof;

$R^2$ is selected from the group consisting of ethylene, 1,9-propylene, 1,3-propylene, 1,2-butylene, 1,4-butylene, and mixtures thereof;

$R^3$ is $C_2$–$C_8$ linear alkylene, $C_3$–$C_8$ branched alkylene, phenylene, substituted phenylene, and mixtures thereof;

Q is a quaternizing unit selected from the group consisting of $C_1$–$C_4$ linear alkyl, $C_1$–$C_4$ hydroxyalkyl, benzyl, $(R^2O)_tY$, and mixtures thereof;

Y is an anionic unit selected from the group consisting of —$(CH_2)_fCO_2M$, —$C(O)(CH_2)_fCO_3M$, —$(CH_2)_fPO_3M$, —$(CH_2)_fOPO_3M$, —$(CH_2)_fSO_3M$, —$CH_2(CHSO_3M)(CH_2)_fSO_3M$, —$CH_2(CHSO_2M)(CH_2)_fSO_3M$, and mixtures thereof; M is hydrogen, a water soluble cation, and mixtures thereof; the index f is from 0 to about 10;

the index t has an average value of from about 0.5 to about 100; the index w is from 0 to 25; the index m is from 0 to 20;

wherein when m is equal to 0, w is equal to 0;

b) from about 0.01% to about 80% by weight, of a surfactant system comprising:

i) from 0% to 80% by weight, of a mid-chain branched alkyl sulfate surfactant selected from the group consisting of surfactants having the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_zOSO_3M,$$

the formula;

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_z(OR^3)_mOSO_3M,$$

and mixtures thereof, wherein R, $R^1$, and $R^2$ are each independently hydrogen, $C_1$–$C_3$ alkyl, and mixtures thereof, provided the total number of carbon ads in said surfactant is from 14 to 20 and at least one of R, $R^1$, and $R^2$ is not hydrogen; the index w is an integer from 0 to 13; x is an integer from 0 to 13; y is an integer from 0 to 13; z is an integer of at least 1; provided w+x+y+z is from 8 to 14 and the total number of carbon atoms in a surfactant is from 14 to 20; $R^3$ is ethylene, 1,2-propylene, 1,3-propylene, 1,2-butylene, 1,4-butylene, and mixtures thereof; the average value of the index m is at least about 0.01 to about 3; M is a water soluble cation;

ii) from 0% to 80% by weight, of a mid-chain branched aryl sulfonate surfactant having the formula:

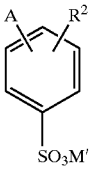

wherein A is a mid-chain branched alkyl unit having the formula:

$$CH_3(CH_2)_x\overset{\overset{\displaystyle R}{|}}{C}H(CH_2)_y\overset{\overset{\displaystyle R^1}{|}}{C}H(CH_2)_z\text{—}$$

wherein R and $R^1$ are each independently hydrogen, $C_1$–$C_3$ alkyl, and mixtures thereof, provided the total number of carbon atoms in said alkyl unit is from 6 to 18 and at least one of R and $R^1$ is not hydrogen; x is an integer from 0 to 13, y is an integer from 0 to 13; z is 0 or 1; $R^2$ is hydrogen, $C_1$–$C_3$ alkyl, and mixtures thereof; M' is a water soluble cation with sufficient charge to provide neutrality;

iii) optionally from 0.01% to about 90 by weight, of a surfactant selected from the group consisting of anionic, nonionic, cationic, zwitterionic, ampholytic surfactants, and mixtures thereof;

c) from about 1% to about 80% by weight, of a peroxygen bleaching system comprising:

i) from about 40% to about 100% by weight, of the bleaching system, a source of hydrogen peroxide;

ii) optionally from about 0.1% to about 60% by weight, of the beaching system, a beach activator;

iii) optionally from about 1 ppb of the composition to about 50% by weight, of a transition-metal bleach catalyst;

iv) optionally from about 0.1% by weight, of a preformed peroxygen bleaching agent; and d) the balance carriers and adjunct ingredients.

9. A composition according to claim 8 wherein said zwitterionic polyamine comprises an anionic-to-cationic charge ratio $Q_r$ of at least 1.

10. A composition according to claim 9 wherein said zwitterionic polyamine comprises an anionic-to-cationic charge ratio $Q_r$ of at least 0.75.

11. A composition according to claim 8 further comprising a peroxygen bleaching system comprising from about 1 ppb of the composition to about 50% by weight, of a transition-metal bleach catalyst.

* * * * *